US011358852B2

(12) United States Patent
Paauwe et al.

(10) Patent No.: US 11,358,852 B2
(45) **Date of Patent: *Jun. 14, 2022**

(54) BEVERAGE DISPENSING ASSEMBLY AND BEVERAGE CONTAINER

(71) Applicant: HEINEKEN SUPPLY CHAIN B.V., Amsterdam (NL)

(72) Inventors: Arie Maarten Paauwe, Naaldwijk (NL); Pieter Gerard Witte, The Hague (NL)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 278 days.

This patent is subject to a terminal disclaimer.

(21) Appl. No.: 16/315,232

(22) PCT Filed: Jul. 5, 2017

(86) PCT No.: PCT/NL2017/050449
§ 371 (c)(1),
(2) Date: Jan. 4, 2019

(87) PCT Pub. No.: WO2018/009065
PCT Pub. Date: Jan. 11, 2018

(65) Prior Publication Data

US 2019/0169013 A1 Jun. 6, 2019

(30) Foreign Application Priority Data

Jul. 5, 2016 (NL) ..... 2017109

(51) Int. Cl.
*B67D 1/04* (2006.01)
*B67D 1/16* (2006.01)
(Continued)

(52) U.S. Cl.
CPC ..... *B67D 1/0406* (2013.01); *B67D 1/06* (2013.01); *B67D 1/0872* (2013.01); *B67D 1/16* (2013.01); *B67D 2001/0814* (2013.01)

(58) Field of Classification Search
CPC ..... B67D 1/0406; B67D 1/06; B67D 1/0872; B67D 1/16; B67D 2001/0814
See application file for complete search history.

(56) References Cited

U.S. PATENT DOCUMENTS 1,979,604 A 11/1934 Burdge
1,983,381 A 12/1934 Frederick
(Continued)

FOREIGN PATENT DOCUMENTS

CL 200101248 A1 4/2002
CL 2007000730 A1 1/2008
(Continued)

OTHER PUBLICATIONS

English Translation of Office action issued in corresponding Chinese Patent Application No. 201780054420.X dated May 26, 2020, 4 pages.
(Continued)

*Primary Examiner* — Jeremy Carroll
(74) *Attorney, Agent, or Firm* — Pearne & Gordon LLP

(57) ABSTRACT

Beverage dispensing assembly, comprising a dispenser and a beverage container, wherein the beverage container has a neck portion and a shoulder portion adjacent the neck portion, wherein the neck portion is provided with at least an outflow opening and at least one gas inlet opening and wherein the dispenser comprises a housing, wherein the housing is provided with a receptacle for receiving at least part of the container, wherein the container is positioned in the dispenser with the neck and shoulder portion facing downward, such that the neck portion and at least part of the
(Continued)

Figure 1A:
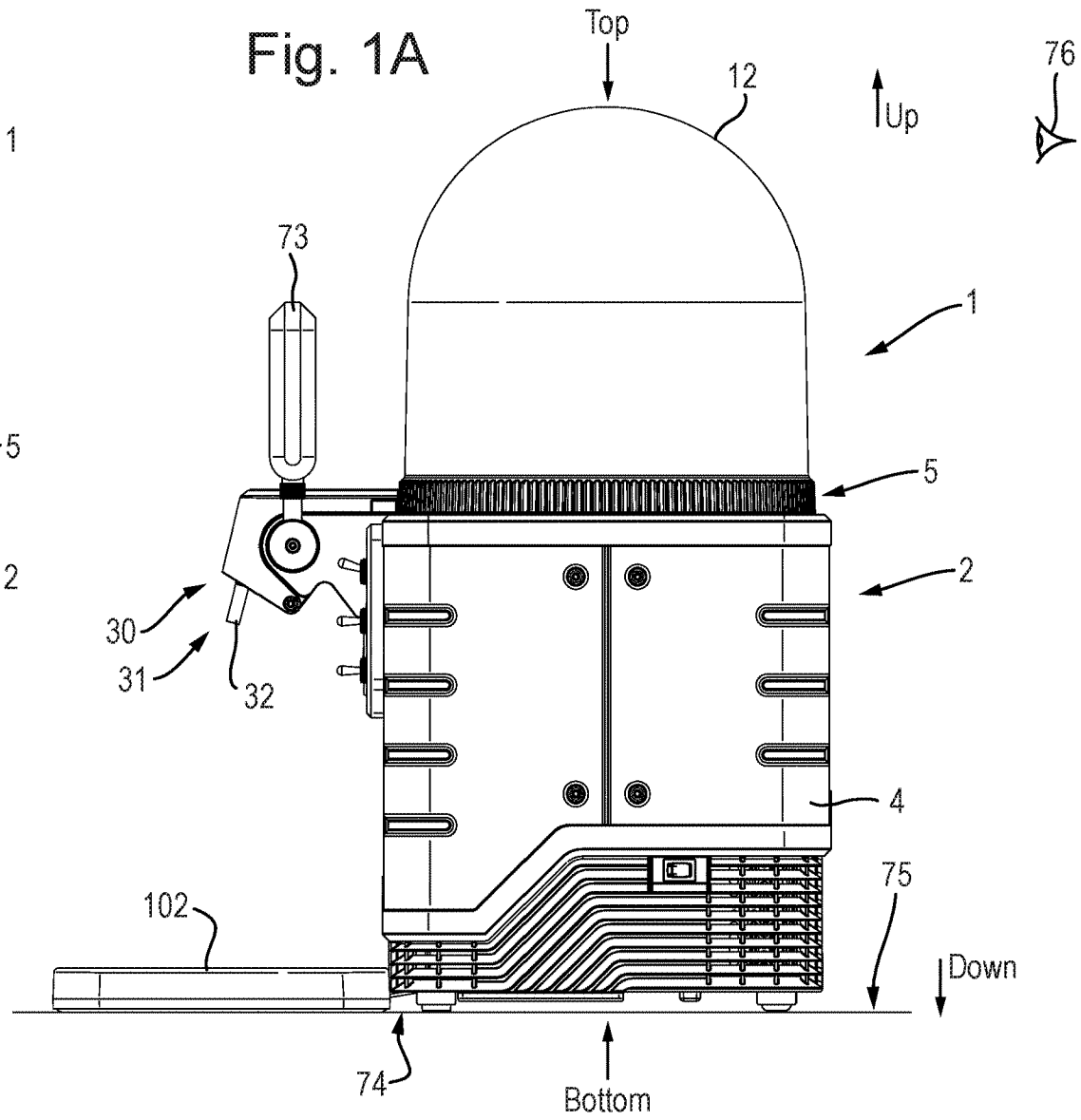

shoulder portion are received in the receptacle, wherein part of the shoulder portion extends close to and/or is in contact with a wall of the receptacle, wherein preferably a lid is provided over the container, enclosing a part of the container extending outside the receptacle.

36 Claims, 20 Drawing Sheets

(51) Int. Cl.
*B67D 1/06* (2006.01)
*B67D 1/08* (2006.01)

(56) References Cited

U.S. PATENT DOCUMENTS 2,191,918 A 2/1940 Stadtfeld et al.
2,781,152 A * 2/1957 Van Slyke ..... B67D 7/0238 222/81
2,966,282 A 12/1960 William
3,871,559 A 3/1975 Smith et al.
5,118,009 A * 6/1992 Novitsky ..... B67B 7/28 222/1
5,165,575 A * 11/1992 Scott ..... B67D 1/0079 222/129.1
5,421,159 A 6/1995 Stokes
5,494,195 A 2/1996 Knuettel, II et al.
5,566,732 A 10/1996 Nelson
5,601,210 A 2/1997 Kelly et al.
5,848,736 A 12/1998 Boumann
5,915,602 A 6/1999 Nelson
6,269,980 B1 * 8/2001 Randall ..... B67D 1/0456 222/145.5
6,360,923 B1 3/2002 Mooswijk
6,375,048 B1 4/2002 Van Der Meer et al.
6,516,839 B1 2/2003 Timp
6,832,487 B1 12/2004 Baker
7,100,803 B2 * 9/2006 Magermans ..... B67D 1/0412 222/183
8,028,857 B2 10/2011 Rasmussen
8,707,508 B2 4/2014 Dyson et al.
8,851,322 B2 10/2014 Landman
8,931,651 B2 1/2015 Van Hove et al.
9,714,117 B2 7/2017 Paauwe et al.
9,815,676 B2 11/2017 Witte et al.
9,895,826 B2 2/2018 Landman
9,895,834 B2 2/2018 Van Hove et al.
9,957,146 B2 5/2018 Witte et al.
10,071,900 B2 9/2018 Witte et al.
10,087,062 B2 10/2018 Witte et al.
2002/0050496 A1 * 5/2002 Van Der Meer ..... B01D 3/20 222/105
2003/0115902 A1 6/2003 Busick et al.
2004/0011828 A1 1/2004 Van Der Klaauw et al.
2004/0040977 A1 3/2004 Mathues
2004/0069805 A1 * 4/2004 Van Der Klaauw ..... B67D 1/1405 222/146.6
2004/0226967 A1 11/2004 Van Der Klaauw et al.
2006/0283879 A1 * 12/2006 Rasmussen ..... B67D 1/14 222/81
2008/0128456 A1 6/2008 Grimwade et al.
2008/0257846 A1 10/2008 Van Hove et al.
2008/0257883 A1 10/2008 Van Hove et al.
2009/0242555 A1 10/2009 Richter
2010/0096040 A1 4/2010 Litto
2010/0237035 A1 9/2010 Van Hove et al.
2010/0242212 A1 9/2010 Dyson et al.
2010/0252583 A1 10/2010 Maas et al.
2011/0024422 A1 2/2011 Valles et al.
2011/0036451 A1 2/2011 Maas et al.
2011/0210148 A1 9/2011 Nelson et al.
2011/0318669 A1 12/2011 Miyake et al.
2012/0067076 A1 * 3/2012 Schroeder ..... B67D 1/0862 62/306
2012/0097711 A1 4/2012 Xianzhi et al.
2012/0104041 A1 5/2012 Coleman et al.
2012/0132607 A1 5/2012 Landman et al.
2012/0138161 A1 6/2012 Wolthers
2012/0187067 A1 7/2012 Maas et al.
2012/0187133 A1 7/2012 Landman
2012/0312837 A1 * 12/2012 Zavarella ..... B67D 1/0418 222/95
2013/0081443 A1 4/2013 Rasmussen et al.
2013/0186916 A1 7/2013 Kulkarni et al.
2013/0221029 A1 8/2013 Vandekerckhove et al.
2014/0131380 A1 5/2014 Pethe et al.
2014/0305898 A1 10/2014 Landman
2014/0353335 A1 12/2014 Van Diepen
2014/0374416 A1 12/2014 Tom et al.
2015/0048117 A1 * 2/2015 Lam ..... B67D 1/045 222/146.6
2015/0158713 A1 6/2015 Orita
2015/0175399 A1 6/2015 Witte et al.
2015/0203342 A1 7/2015 Witte et al.
2015/0210523 A1 7/2015 Witte et al.
2015/0210524 A1 7/2015 Witte et al.
2015/0239160 A1 8/2015 Van Hove et al.
2015/0282651 A1 10/2015 Paauwe et al.
2015/0284157 A1 10/2015 Paauwe et al.
2015/0290598 A1 10/2015 Van Damme
2015/0328819 A1 11/2015 Tom et al.
2016/0236820 A1 8/2016 Paauwe et al.
2017/0107092 A1 4/2017 Peirsman et al.
2017/0217049 A1 8/2017 Landman et al.
2017/0240409 A1 8/2017 Valles et al.
2017/0283118 A1 10/2017 Paauwe et al.
2018/0044160 A1 2/2018 Witte et al.
2018/0170743 A1 6/2018 Witte et al.
2018/0346312 A1 12/2018 Witte et al.
2019/0169013 A1 6/2019 Paauwe et al.
2020/0102198 A1 4/2020 Paauwe et al.

FOREIGN PATENT DOCUMENTS

CL 2009000868 A1 4/2010
CN 1617828 5/2005
CN 101827779 A 9/2010
CN 102149627 A 8/2011
CN 102574673 A 7/2012
CN 202657495 1/2013
CN 103562123 2/2014
CN 104783661 A 7/2015
CN 106185773 12/2016
CN 109641734 4/2019
DE 29608717 8/1996
DE 20118605 U1 2/2002
DE 202015001455 U1 7/2016
DE 202016006138 U1 11/2016
EA 7507 B1 10/2006
EA 7691 B1 12/2006
EA 12761 B1 12/2009
EP 1003686 A1 5/2000
EP 2080708 A1 7/2009
EP 2148771 A1 2/2010
EP 2238041 A1 10/2010
EP 2325134 A1 5/2011
EP 2405517 A1 1/2012
EP 2413762 A1 2/2012
EP 2447207 A1 5/2012
EP 2448734 A1 5/2012
EP 2448858 A1 5/2012
EP 2857346 A1 4/2015
EP 2860149 A2 4/2015
EP 2882679 A1 6/2015
EP 2882680 A1 6/2015
EP 2885241 A2 6/2015
EP 2885242 A2 6/2015
EP 2914542 A2 9/2015
EP 2917148 A2 9/2015
EP 2920080 A2 9/2015
EP 2923997 A1 9/2015

(56) References Cited

FOREIGN PATENT DOCUMENTS

| | | | |
|---|---|---|---|
| EP | 2987767 | A1 | 2/2016 |
| JP | 57-159698 | | 3/1981 |
| JP | S56045650 | | 10/1982 |
| JP | S57166235 | | 4/1984 |
| JP | S63-175096 | U | 11/1988 |
| JP | S62026977 | | 11/1988 |
| JP | H03503273 | | 7/1991 |
| JP | H03504226 | | 9/1991 |
| JP | 2001-504786 | A | 4/2001 |
| JP | 2002068381 | | 3/2002 |
| JP | 2002145397 | | 5/2002 |
| JP | 2002145398 | A | 5/2002 |
| JP | 2003535/// | | 12/2003 |
| JP | 3102953 | | 7/2004 |
| JP | 3102953 | U | 7/2004 |
| JP | 2006525195 | | 11/2006 |
| JP | 2007091232 | | 4/2007 |
| JP | 2009120221 | | 6/2009 |
| JP | 2009196684 | | 9/2009 |
| JP | 2009537413 | | 10/2009 |
| JP | 2009275934 | | 11/2009 |
| JP | 2010076814 | | 4/2010 |
| JP | 2010540359 | | 12/2010 |
| JP | 3170185 | | 9/2011 |
| JP | 3170185 | U | 9/2011 |
| JP | 2011235905 | | 11/2011 |
| JP | 2012532074 | | 12/2012 |
| JP | 5179691 | B2 | 4/2013 |
| JP | 2013-086874 | A | 5/2013 |
| JP | 2013116757 | | 6/2013 |
| JP | 2013252867 | | 12/2013 |
| JP | 2014076814 | | 5/2014 |
| JP | 2014520042 | | 8/2014 |
| JP | 5623667 | | 11/2014 |
| JP | 2016504245 | | 2/2016 |
| JP | 2020-520862 | A1 | 7/2020 |
| NL | 1006949 | C2 | 3/1999 |
| NL | 1008601 | C2 | 9/1999 |
| RU | 105277 | U1 | 6/2011 |
| RU | 2533721 | C2 | 11/2014 |
| RU | 2568569 | C2 | 11/2015 |
| RU | 2015106359 | A | 9/2016 |
| WO | 99/11561 | A1 | 3/1999 |
| WO | 9911563 | A1 | 3/1999 |
| WO | 0003944 | A1 | 1/2000 |
| WO | 0192145 | A1 | 12/2001 |
| WO | 03027582 | A2 | 4/2003 |
| WO | 2003035540 | | 5/2003 |
| WO | 2004099060 | A2 | 11/2004 |
| WO | 2005040035 | A1 | 5/2005 |
| WO | 2006087148 | A1 | 8/2006 |
| WO | 2008085053 | A1 | 7/2008 |
| WO | 2009074285 | A2 | 6/2009 |
| WO | 2011002293 | A1 | 1/2011 |
| WO | 2011002294 | A2 | 1/2011 |
| WO | 2011002295 | A1 | 1/2011 |
| WO | 2011051475 | A1 | 5/2011 |
| WO | 2012056017 | A1 | 5/2012 |
| WO | 2013096579 | A1 | 6/2013 |
| WO | 2014017907 | A2 | 1/2014 |
| WO | 2014017907 | A3 | 1/2014 |
| WO | 2014017908 | A1 | 1/2014 |
| WO | 2014017909 | A1 | 1/2014 |
| WO | 2014017910 | A2 | 1/2014 |
| WO | 2014018294 | A1 | 1/2014 |
| WO | 2014070003 | A2 | 5/2014 |
| WO | 2014070004 | A2 | 5/2014 |
| WO | 2014077681 | A2 | 5/2014 |
| WO | 2014081294 | A2 | 5/2014 |
| WO | 2015144685 | | 10/2015 |
| WO | 2017/067788 | A1 | 4/2017 |

OTHER PUBLICATIONS

English Translation of Search Report issued in corresponding Chinese Patent Application No. 201780054420.X, 3 pages.

English Translation of Office action issued in corresponding Russian Patent Application No. 2019102928 dated Sep. 2, 2020, 6 pages.

English Translation of Search Report issued in corresponding Russian Patent Application No. 2019102928 dated Sep. 2, 2020, 3 pages.

Office Action issued in corresponding Indian Application Serial No. 201947004547 dated Mar. 15, 2021, 7 pages.

Decision of Grant for Russian Application No. 2019102928 dated Dec. 3, 2021, 10 pages.

* cited by examiner

BEVERAGE DISPENSING ASSEMBLY AND BEVERAGE CONTAINER

The invention relates to a beverage dispensing assembly. The invention in particular relates to a beverage dispensing assembly for dispensing a carbonated beverage from a plastic container. The invention further relates to a container for use in a beverage dispensing assembly of the invention.

EP1003686 discloses a beverage dispensing assembly, comprising a dispenser and a beverage container having a neck portion and a shoulder portion adjacent the neck portion, wherein the neck portion is provided with an outflow opening for beverage. The container is a compressible container, which is inserted into an inner space of the dispenser, closed by a lid portion attached to the container. During use a pressure is built up inside said inner space, compressing the container and thus pressurizing the beverage for dispensing. EP2448858 discloses a similar dispensing assembly, having the outflow opening facing upward, wherein a closure for the pressure space connects sealingly to the neck portion of the container, at the same time suspending the container within said space.

WO2004099060 discloses a beverage dispensing assembly, similar to that of NL1006949, in which the container is inverted during use, an outflow opening facing downward. Again the container is provided with a closure ring cooperating with closure means of the dispenser for closing a pressure space in which the container is compressed for pressurizing and dispensing the beverage.

Such assemblies are complex in design and use, since it necessitates a container and dispenser suitable for cooperation for closing the pressure space.

EP2448734 discloses a BIC type container having a closure provided with a beverage valve. A gas inlet opening is provided in the closure for connecting a gas supply to the container, especially to a space between an inner and outer container of the BIC type container. The container is positioned having an outflow opening with the closure facing upward.

It has further been known, as is for example known from Heineken's BeerTender® and disclosed in WO00/03944, to dispense beverages from a bag-in-container type of container, in which a beverage is contained inside a flexible inner container, which is suspended in a more rigid outer container. In such system a pressurizing gas can be inserted into the container, between the inner and outer container, thereby compressing the bag or inner container, squeezing out the beverage without the pressurizing gas coming into direct contact with the beverage.

In EP2148771 an integrally blow moulded bag-in-container is disclosed, for holding and dispensing beverages, wherein at least one vent is provided running parallel to an interface between inner and outer containers, which vent opens to the atmosphere at a location adjacent to and orientated approximately coaxially with the bag-in-container's mouth. EP2148771 fails to disclose how this container is used in a dispensing assembly, especially how this is to be connected to a tapping line or tapping device.

WO2011/002294 discloses an integrally blow moulded bag-in-container type container, wherein at a neck region of the inner container an opening is provided, opening into a space between the inner and outer container. A closure can be provided, with a valve and a gas feed channel, connecting to said opening for feeding gas under pressure into said space. The full gas pressure is therein exerted on the neck region of the outer container, in the neck region. In an alternative embodiment the opening could be in the neck of the outer preform or container.

The present invention aims at providing a beverage dispensing assembly which is an alternative to the known assemblies. The present invention aims at providing a beverage dispensing assembly which is relatively easy in use. The present invention aims at providing a beverage dispensing assembly which is relatively easy to manufacture and maintain. The invention aims at providing a container suitable for a dispensing assembly as claimed.

In an aspect a beverage dispensing assembly can be characterized by a dispenser and a beverage container. The beverage container has a neck portion and a shoulder portion adjacent the neck portion, wherein the neck portion is provided with at least an outflow opening and at least one gas inlet opening. The dispenser comprises a housing and preferably a lid. The housing is provided with a receptacle for receiving at least part of the container, such that the container is positioned in the dispenser with the neck and shoulder portion facing downward. The neck portion and at least part of the shoulder portion are received in the receptacle, wherein part of the shoulder portion extends close to and/or is in contact with a wall of the receptacle. A lid may be provided over the container, enclosing a part of the container extending outside the receptacle.

The container may be provided with a dispensing unit, including at least a dispensing line, and the housing may comprise a tap for connecting to and/or cooperating with the dispensing line. The dispensing line is preferably a disposable line. Disposable should be understood at least as meaning that it is designed for use with a limited number of containers to be emptied, especially only one. In embodiments the dispensing unit can be connected to the container and/or an adapter connected to the container, such that it cannot be removed from the container without damage to such extend that it cannot be reused with another container.

The housing can comprise a cooling device for cooling at least a part of the wall of the receptacle. Preferably the cooling device is for contact cooling of a part of at least the shoulder portion of the container. The receptacle can be substantially bowl shaped, preferably semi-spherical. In embodiments the container can be supported by at least a part of the wall of the receptacle. In embodiments the receptacle can be provided with an indentation at a lower end thereof for receiving the neck portion of the container. If an adapter is provided at the container neck portion, the indentation may receive said adapter too.

In embodiments having a lid the lid can be at least partly transparent, such that at least part of the container extending outside the receptacle can be seen through the lid. A lid can in embodiments rest on the housing, sealing a space between the lid and an outer surface of the container, wherein the lid isolates the container from a surrounding space. The lid can be a double walled lid and the lid can be made of plastic and/or glass. In embodiments lighting can be provided for illuminating at least part of the lid, wherein the lighting is preferably provided in the housing, emitting light into the lid from a lower end thereof resting on said housing.

The container can be provided with a closure ring closing off the outflow opening. A beverage valve can be provided in and/or on the closure ring. Preferably the closure ring and/or the neck portion of the container is or are provided with the at least one gas inlet opening, for introducing a fluidum, preferably gas, under pressure into the container, preferably between an inner and an outer container of the container.

In embodiments an adapter is provided at the neck portion of the container. The adapter can be an adapter fitting over at least part of the neck portion of the container, wherein the adapter comprises at least part of a dispensing unit. The dispensing unit can in embodiments include at least a dispensing line, wherein the dispensing line at a first end is provided with a connector or dispense adapter for connecting to the outflow opening or a beverage dispensing valve provided in said outflow opening, and at an opposite end is provided with a beverage dispense opening. The beverage dispense opening is preferably provided by a dispense valve integral to or connected to the dispense line, more preferably disposable with the dispense line. The adapter can be arranged for connecting a gas connector of the dispenser with the at least one gas inlet opening.

In embodiments a beverage dispensing assembly can comprise a container which is a BIC type container, comprising an outer container and an inner container. At least one gas inlet opening can be provided in the neck portion of the container, in a peripheral wall portion of container, preferably in a peripheral wall portion of the neck portion of the outer container. The gas inlet opening can open into a space between the inner and outer container. The adapter covers at least said at least one gas inlet opening, and is provided with at least one adapter opening extending radially outward, in fluid communication with the said at least one gas inlet opening, and in fluid connection with a gas connector of the dispenser. In such embodiments the housing can be provided with a supply for gas under pressure, especially a gas compressor, connected to the gas connector.

In embodiments the receptacle can be provided with an indentation at a lower end thereof for receiving the neck portion of the container with the adapter. The adapter and the indentation are preferably provided with orientation defining elements, such that the position of the adapter within said indentation is defined in a desired orientation relative to a gas connector of the dispenser.

In embodiments the dispenser can be provided with at least one gas connector, movable relative to the container and/or the receptacle, preferably substantially radially relative to a longitudinal axis of the neck portion of the container. The gas connector is preferably movable mechanically, more preferably electro mechanically.

The dispenser can in embodiments be provided with at least one sensing element, movable relative to the container and/or receptacle, which sensing element engages the container and/or an adapter mounted on the neck portion of the container for sensing a correct position of the container and/or adapter in said receptacle. The sensing element can be part of or form a locking element for locking the container inside the apparatus. The sensing element and the at least one gas connector can be coupled such that the gas connector can only be brought into an extended state if the sensing element detects a correct position of the container and/or an adapter thereof or the sensing element detects a correct position of the container or an adapter thereof or senses no container or adapter thereof. Obviously other types and positions of sensing elements can be used for sensing the presence of and/or correct positioning of a container. Based on a signal from such sensing element an activation signal can be provided, for example for starting cooling, starting pressure fluid supply, starting illumination and other functions.

In embodiments the receptacle can be provided with a channel extending from an indentation near a lower end thereof upward in a wall portion of the receptacle, wherein a dispensing line extends inside said channel.

In embodiments the container is a plastic container, especially a BIC type container. The container can be a BIC type container, comprising an outer container and an inner container, wherein the inner container is substantially filled with a beverage and wherein the inner container at least has a shoulder portion which is flexible, such that the beverage pushes the shoulder portion of the inner container against an inner surface of the outer container within the receptacle.

In embodiments a beverage container according to the disclosure can be a BIC type container, preferably integrally blow moulded from a preform assembly made of plastic, more preferably made of a crystalline or semi-crystalline plastic such as PET and/or PEN and/or PEF. The container can be provided with an adapter at a neck portion of the container, wherein the adapter connects to a gas inlet opening of the container and is provided with at least one adapter opening extending radially outward, in fluid communication with the said at least one gas inlet opening; and/or is provided with a dispensing unit including at least a dispensing line; and/or is provided with a non-circular outer portion for specific orientation of the adapter inside the housing. In embodiments the adapter is provided with an end surface with a slot or channel for receiving part of a or the dispensing line, preferably such that the container can rest on the end surface without restricting flow of beverage through said dispense line.

In embodiments the invention is directed to a tapping assembly which is or can be positioned on a bar surface, wherein the container is visible from at least two opposite sides of the bar, at least for a part extending above a housing of the assembly in which the container is partly inserted. The part extending above the housing can comprise branding.

Figure 1:
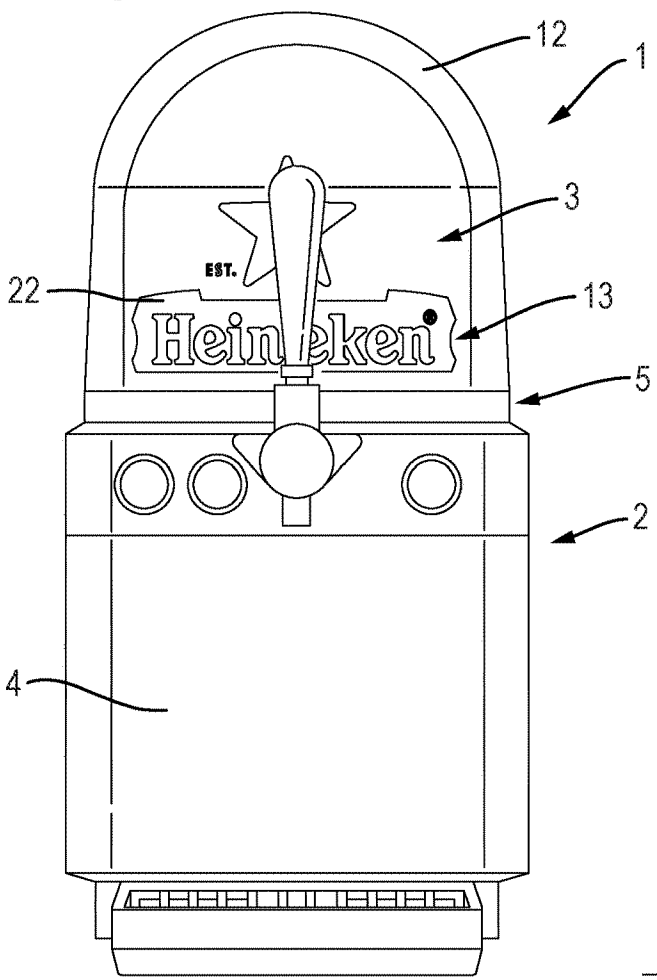
Figure 2A:
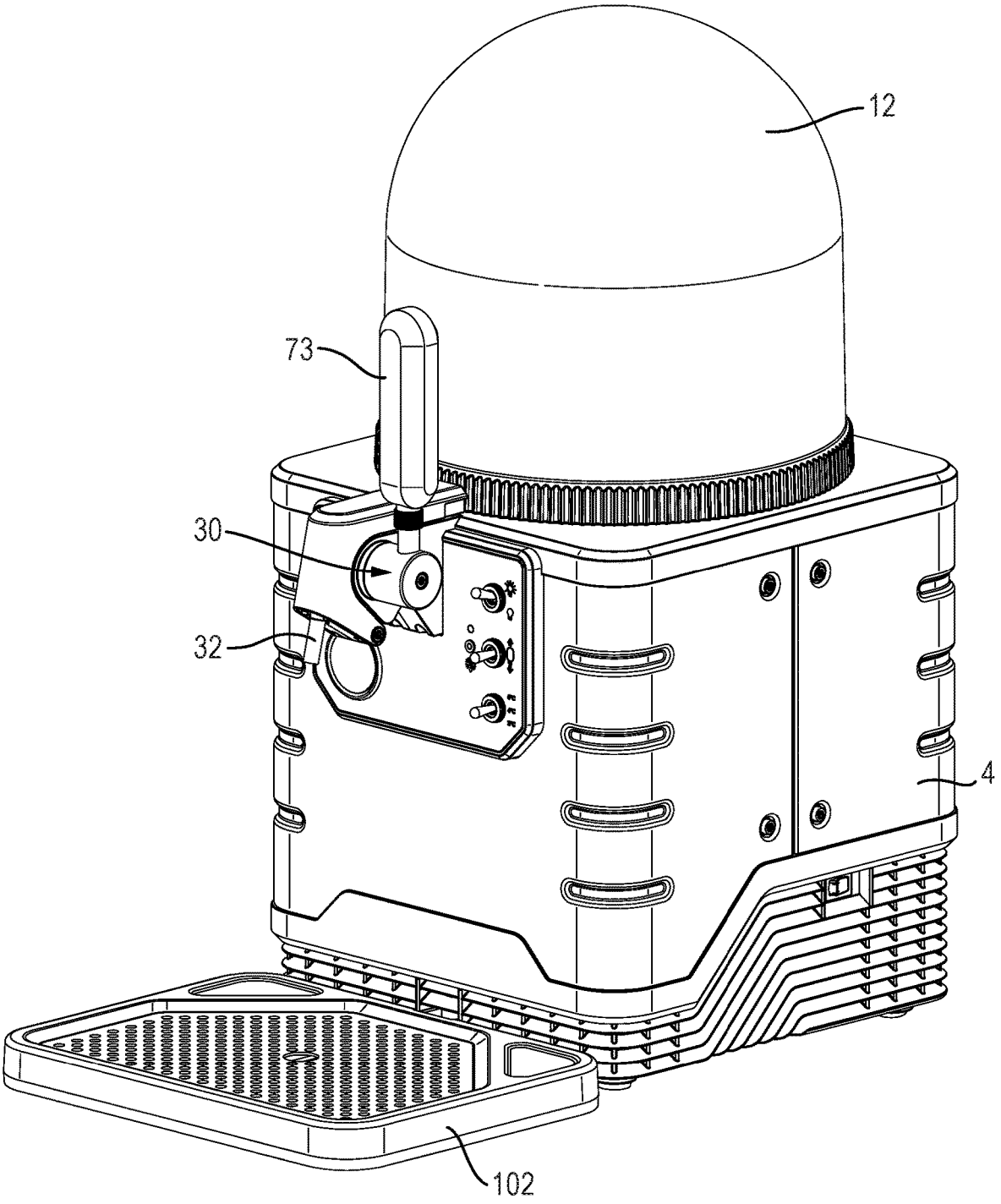
Figure 2B:
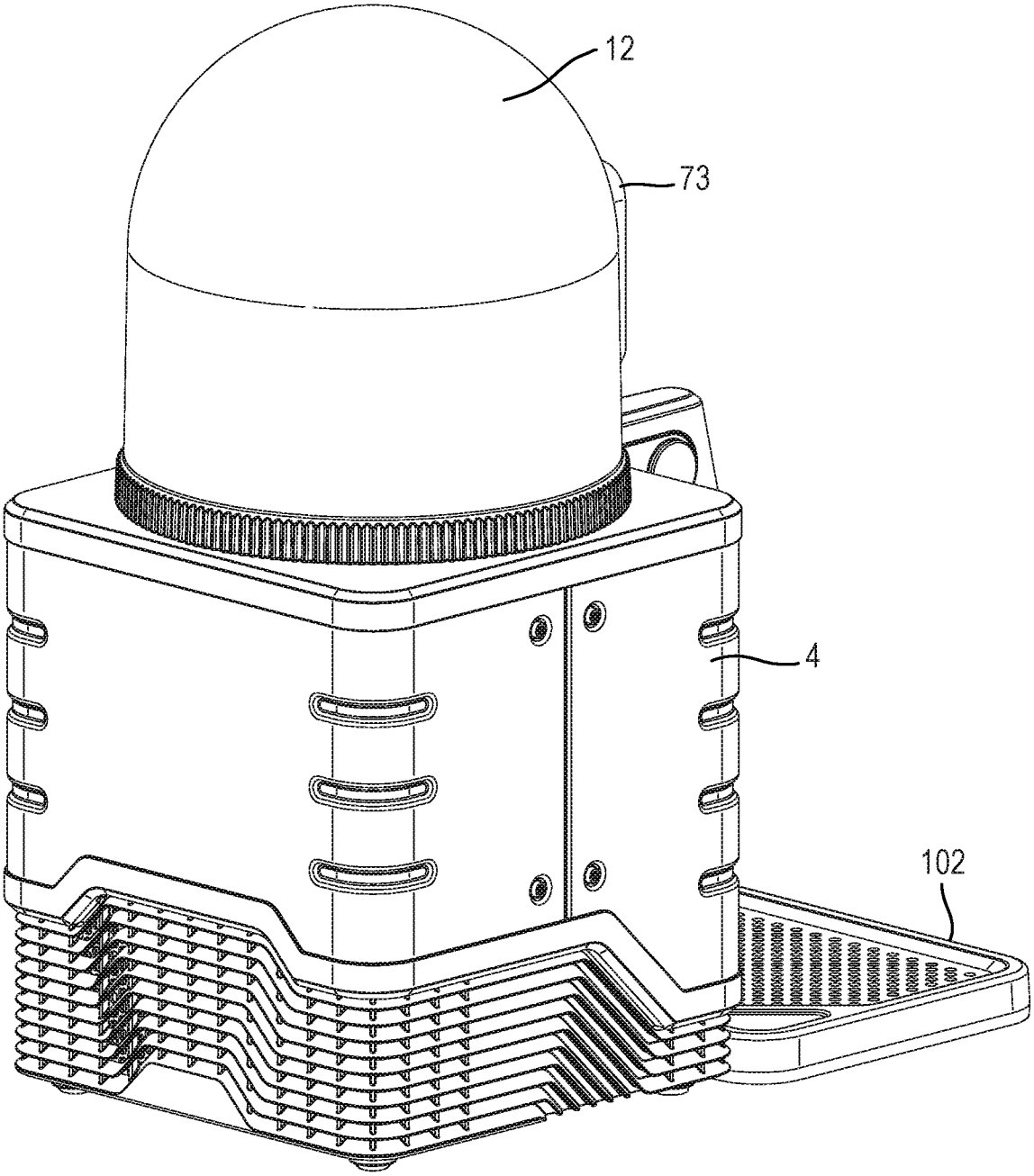
Figure 3A:
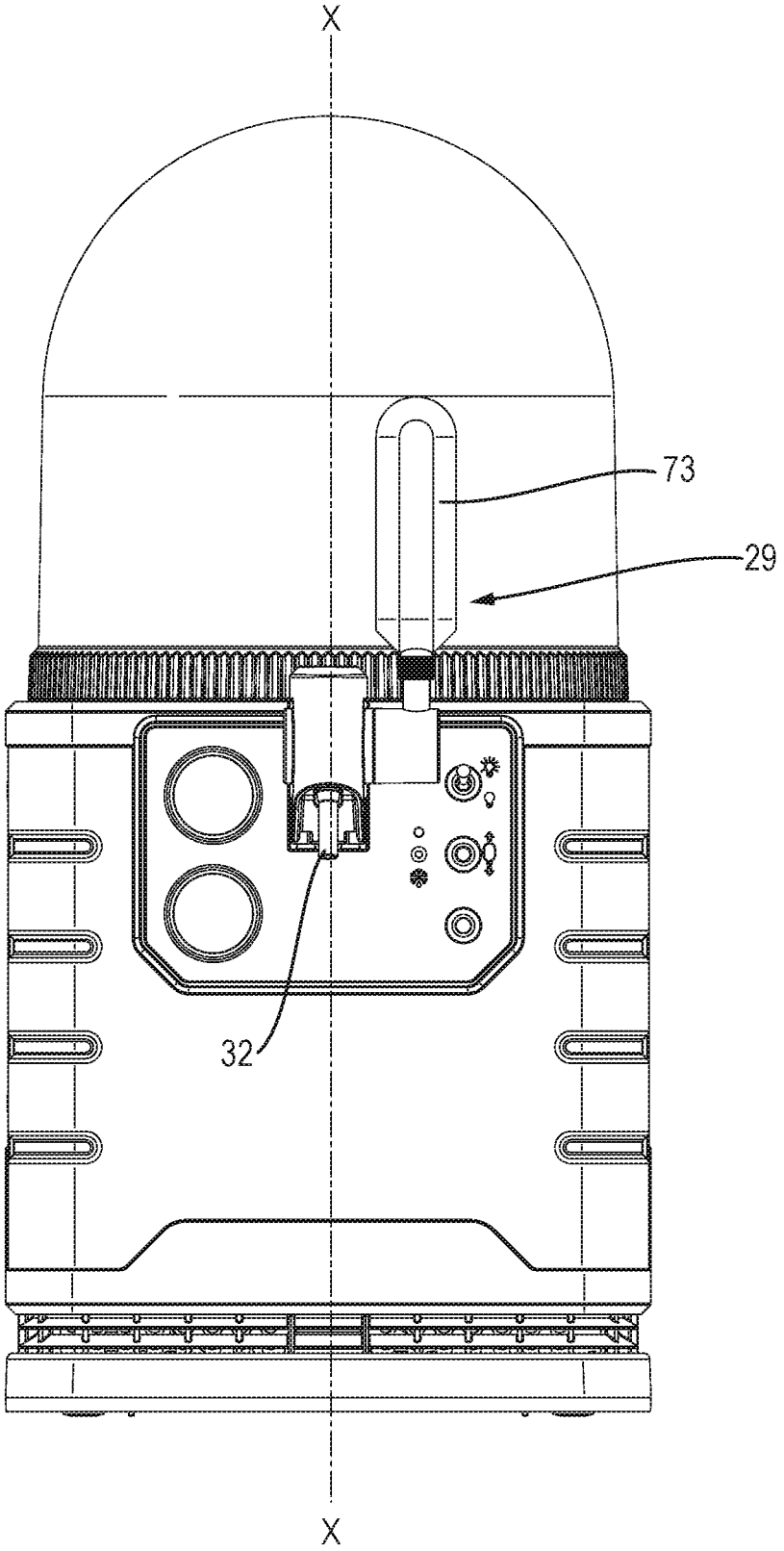
Figure 4:
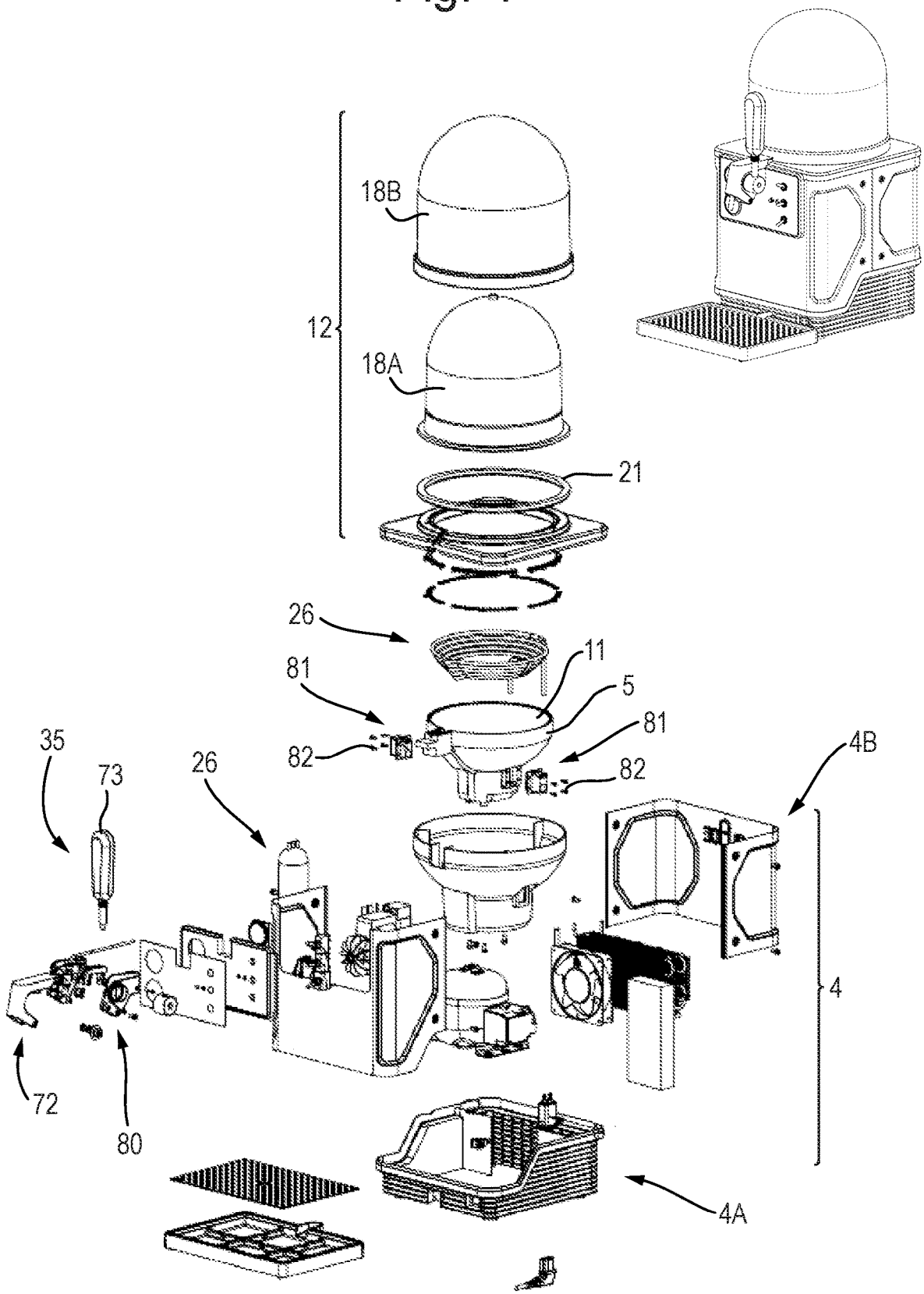
Figure 5:
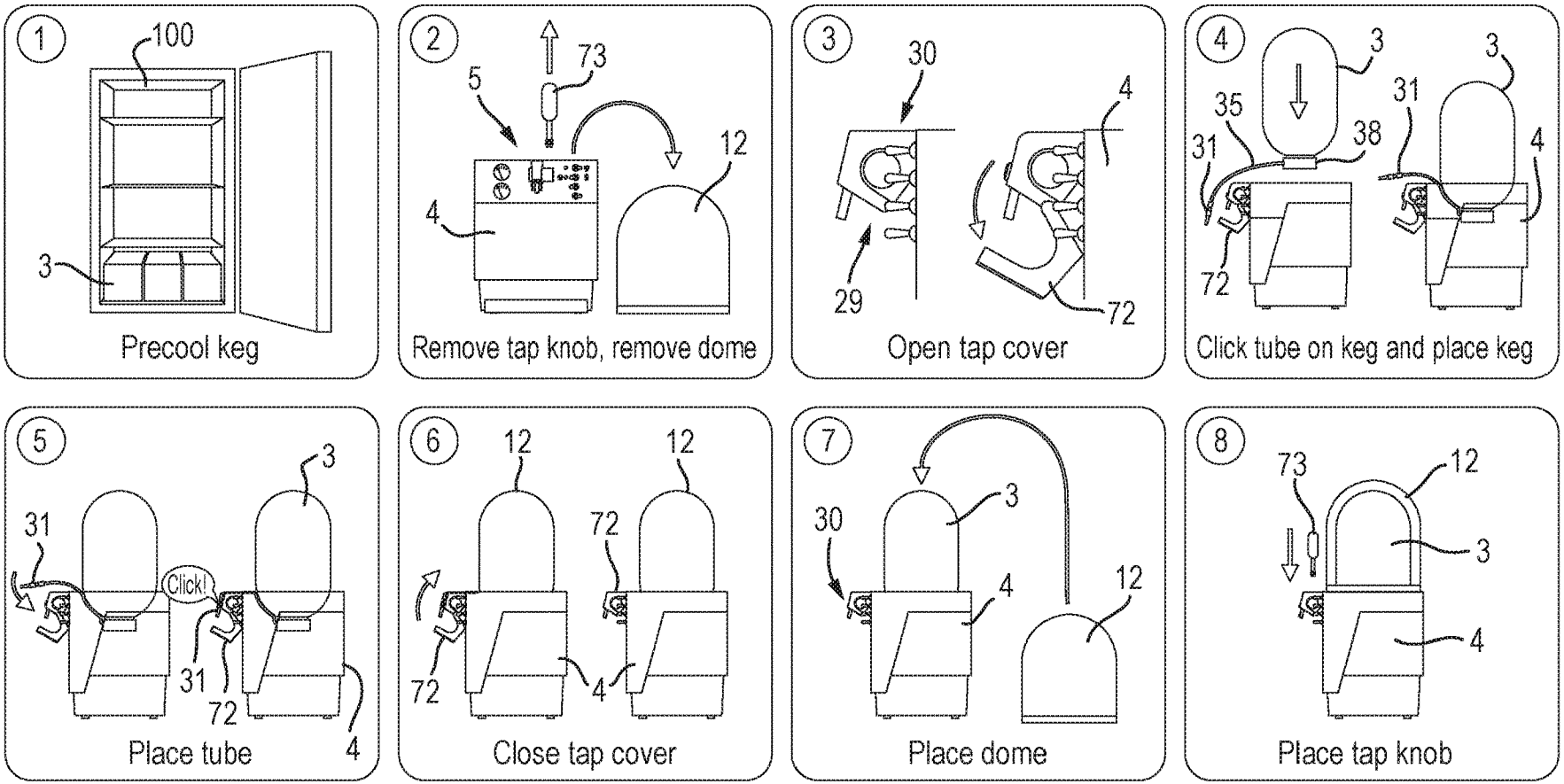
Figure 6A:
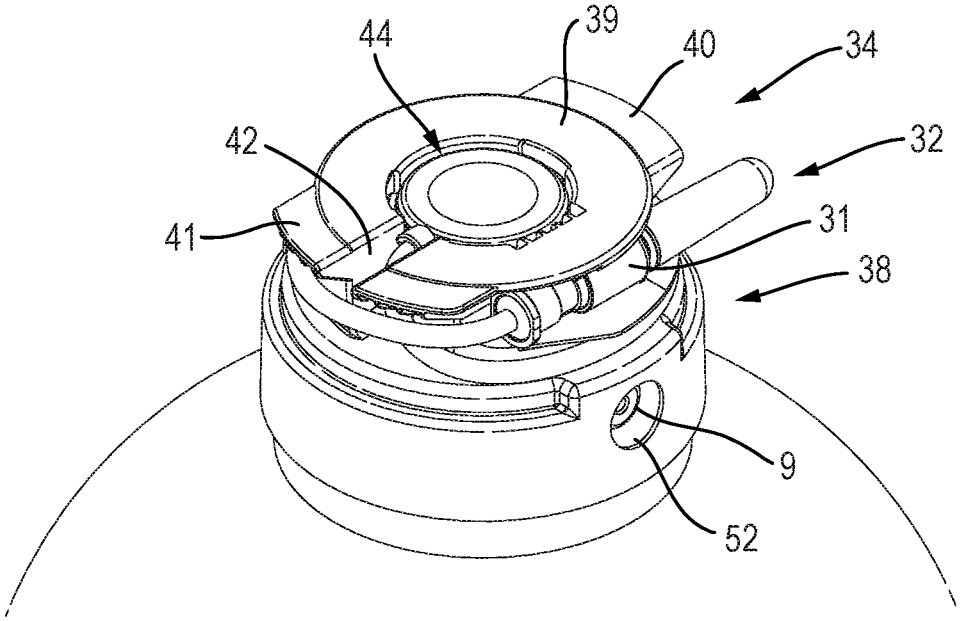
Figure 6B:
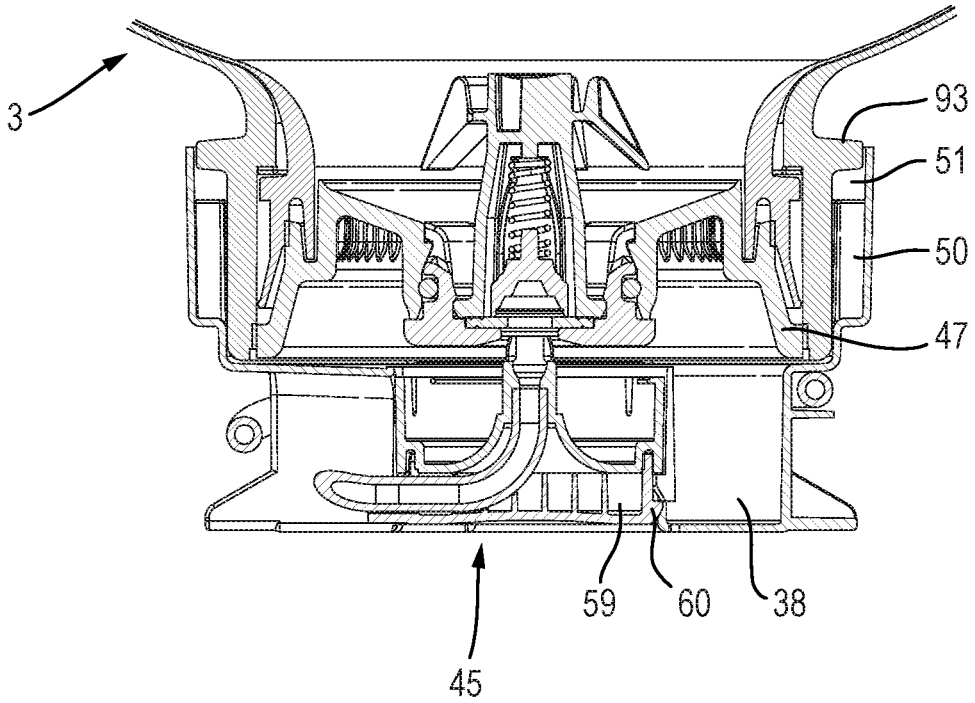
Figure 6C:
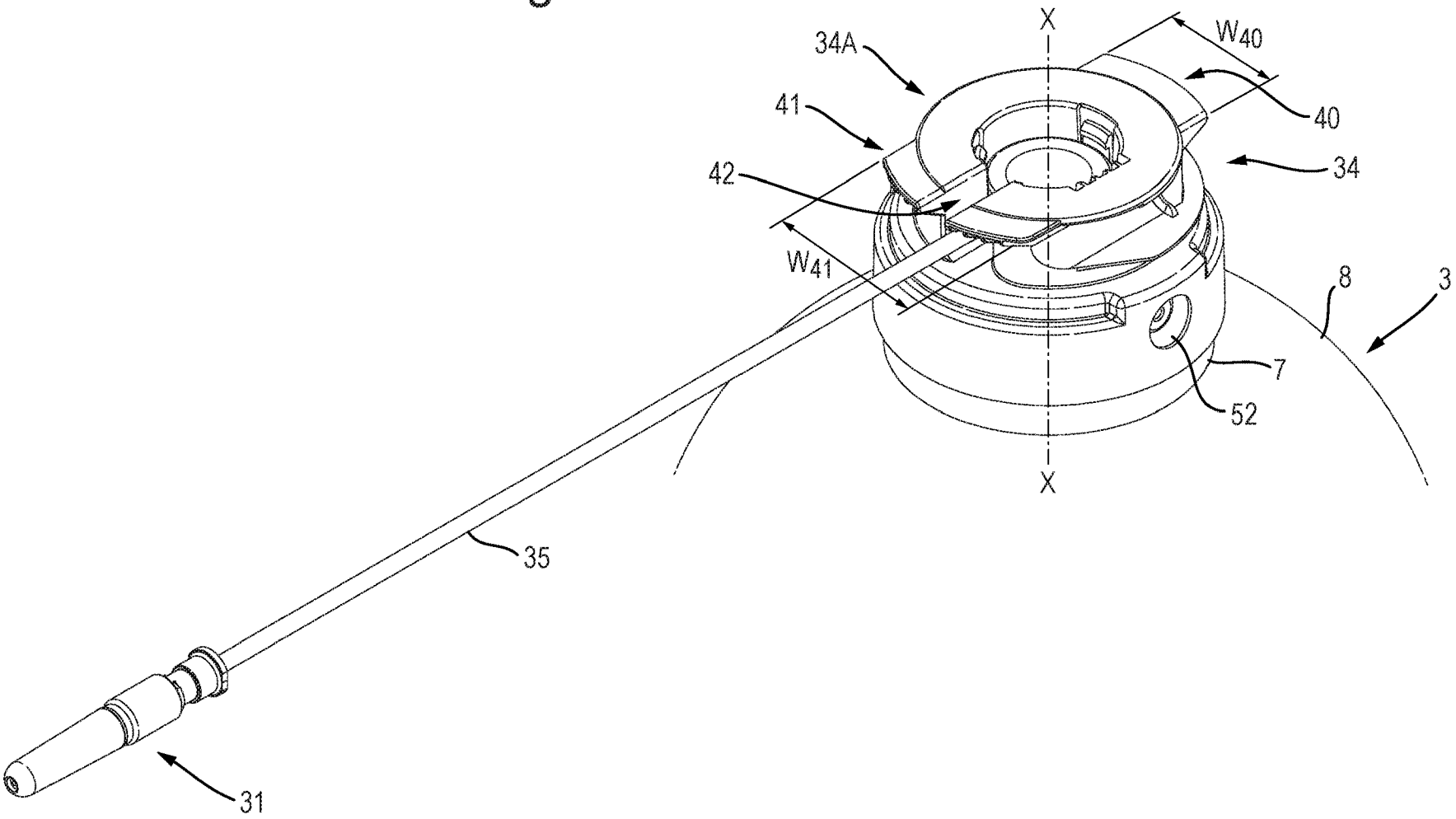
Figure 6D:
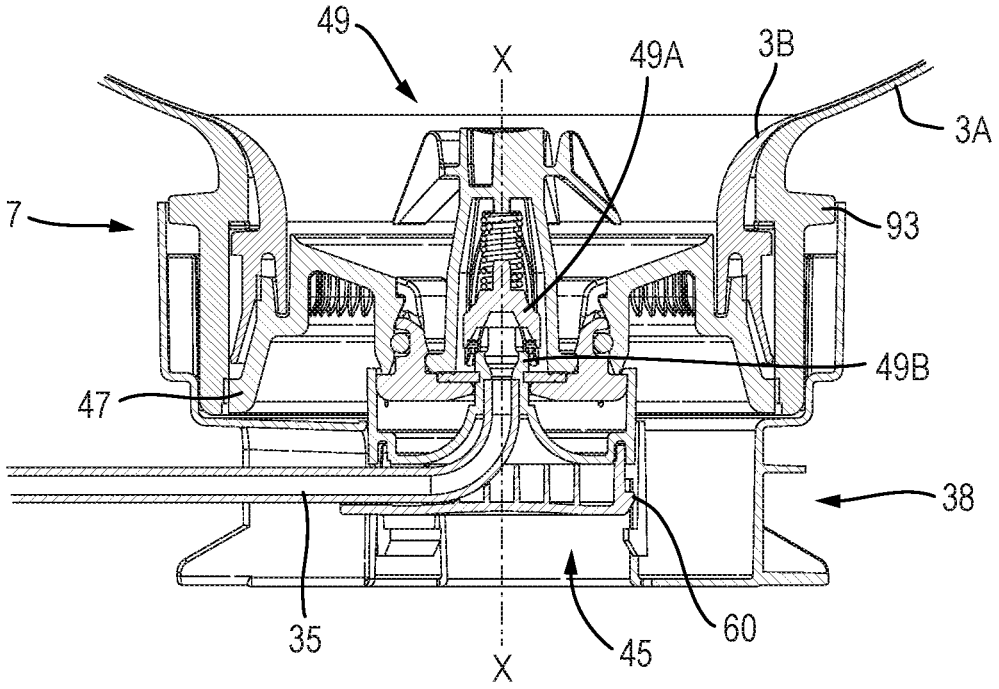
Figure 6E:
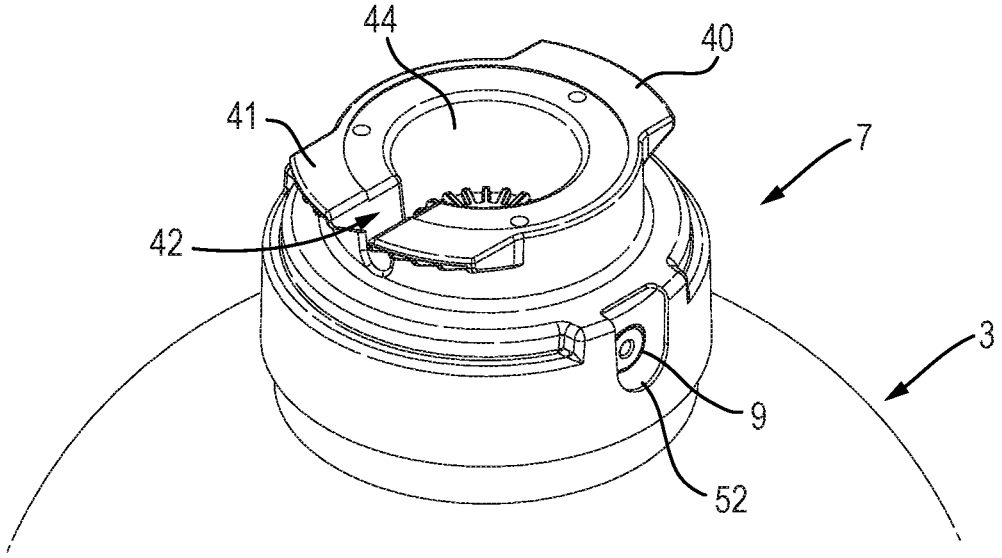
Figure 6F:
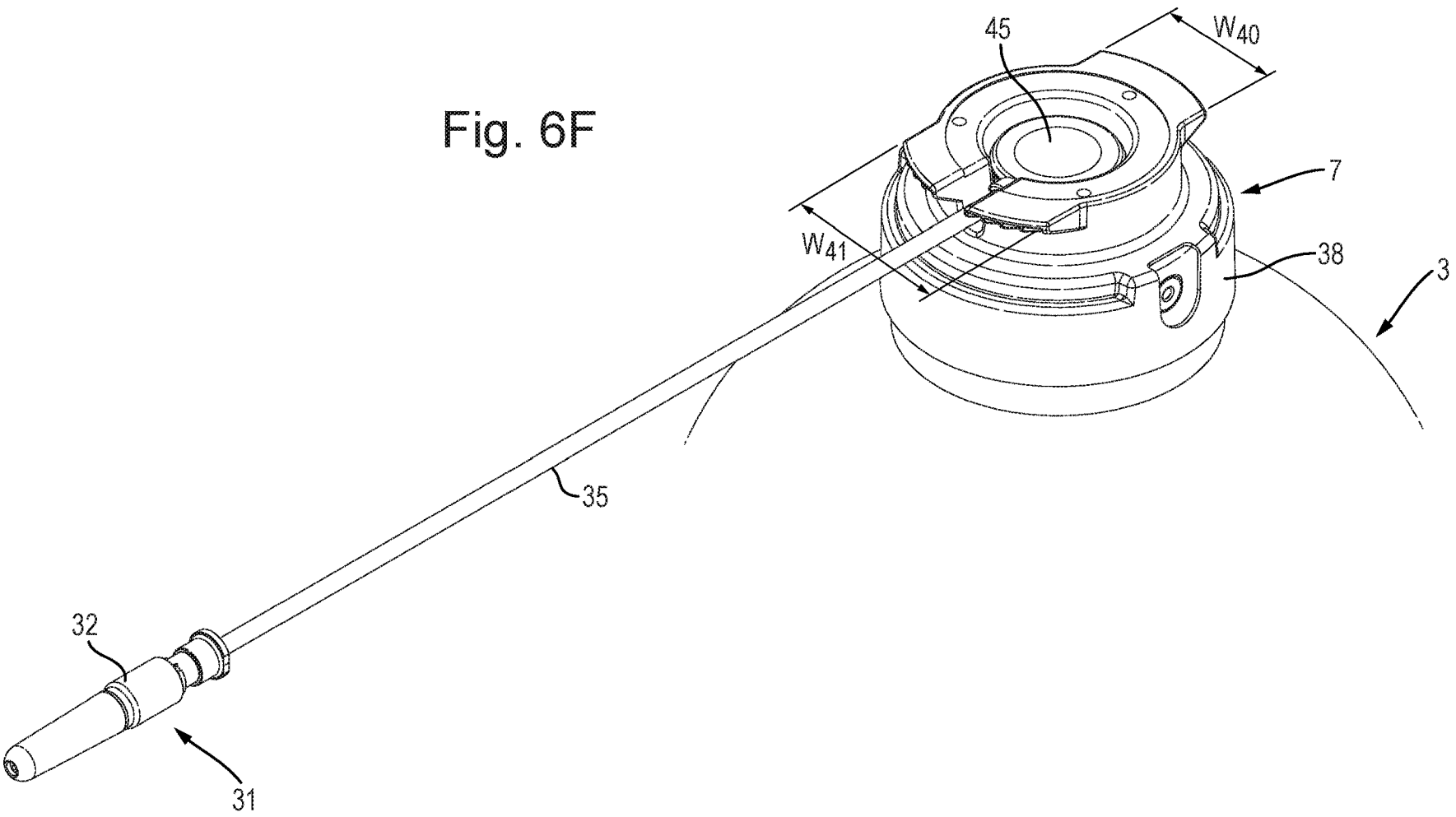
Figure 6G:
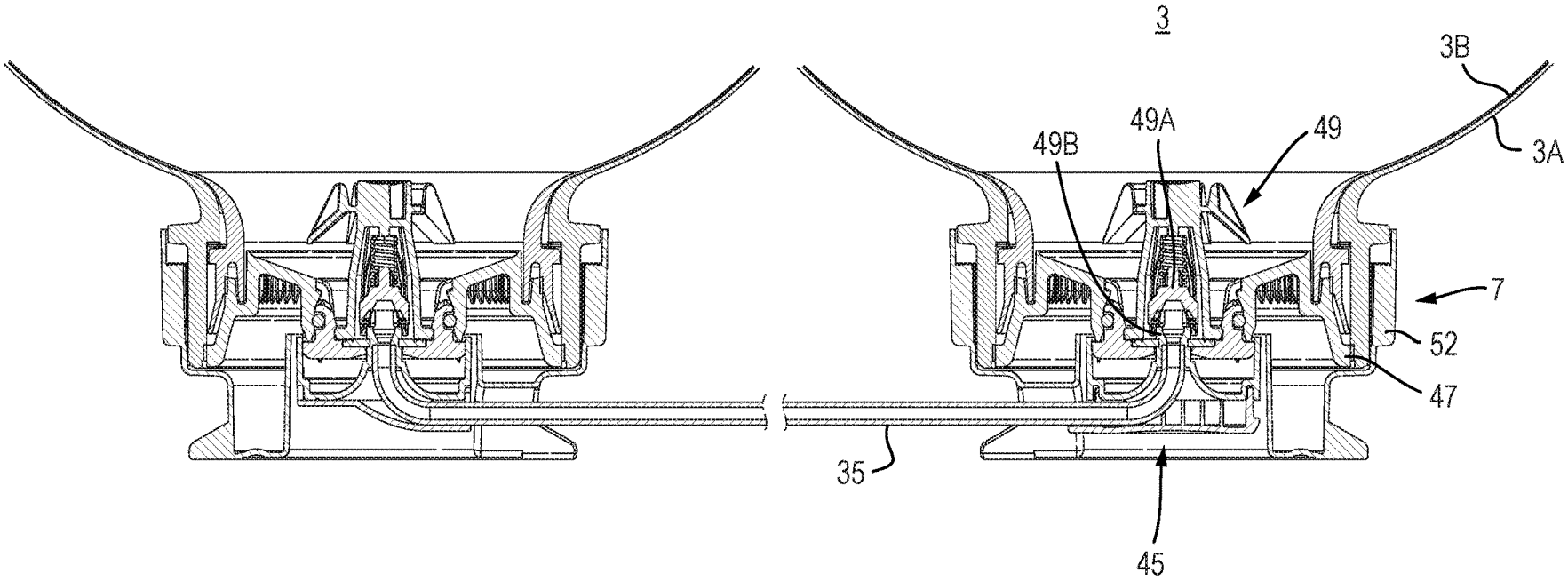
Figure 6H:
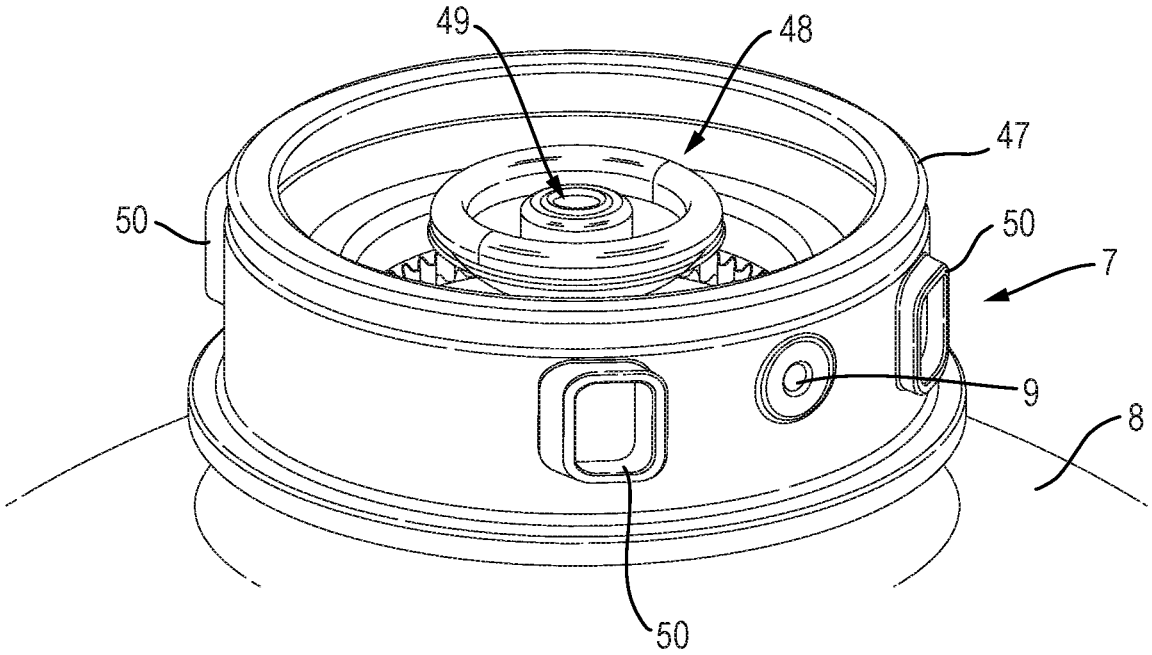
Figure 7:
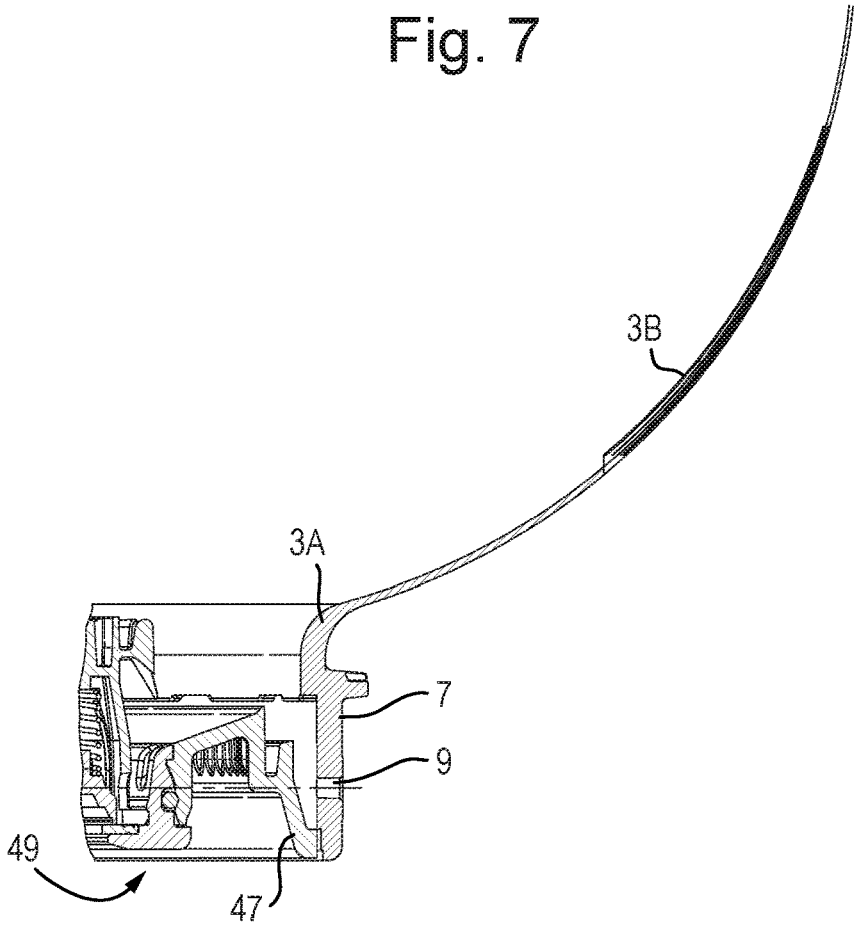
Figure 8:
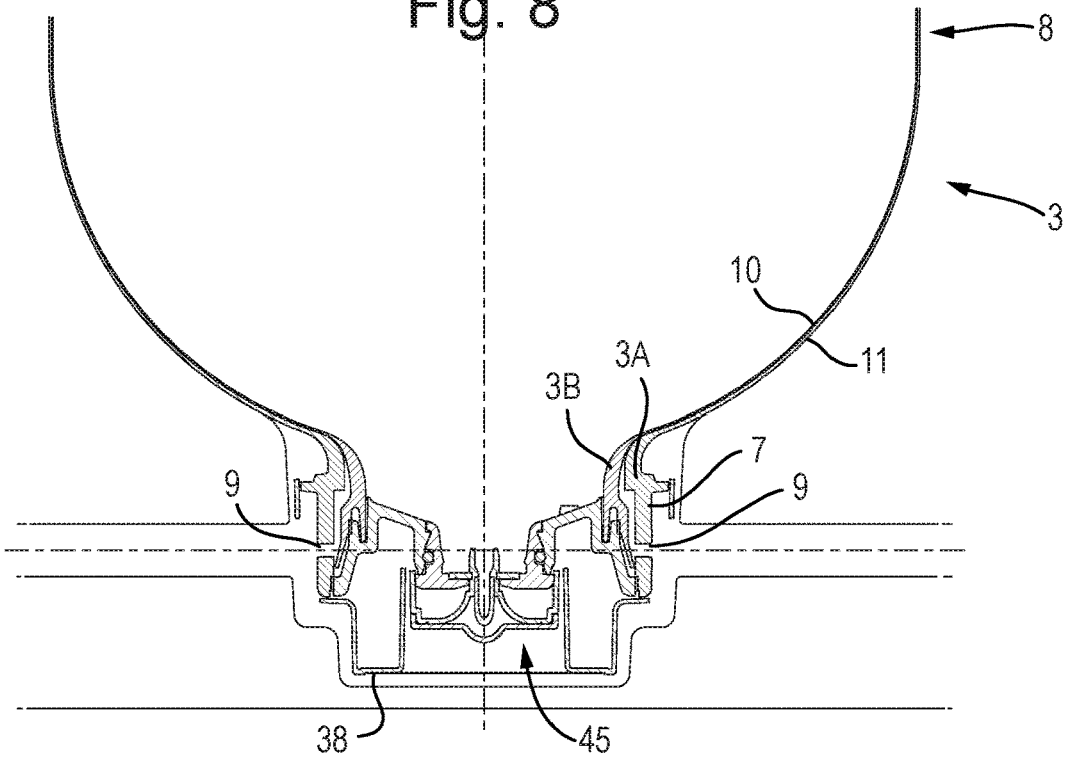
Figure 9:
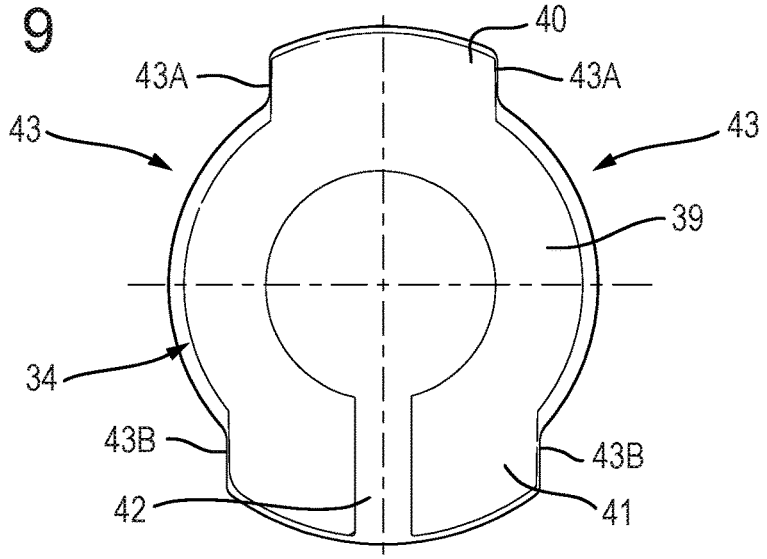
Figure 10:
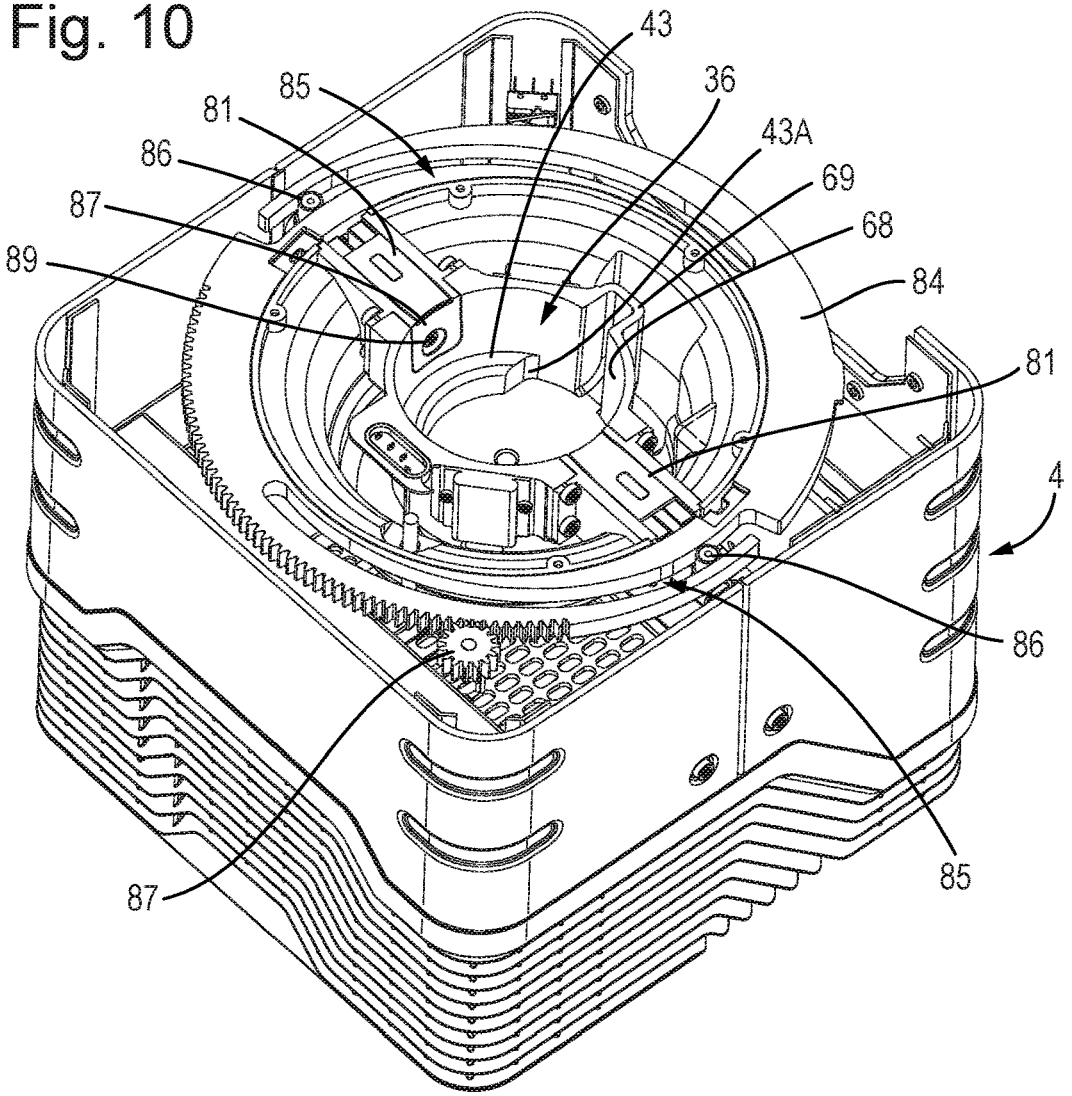
Figure 11:
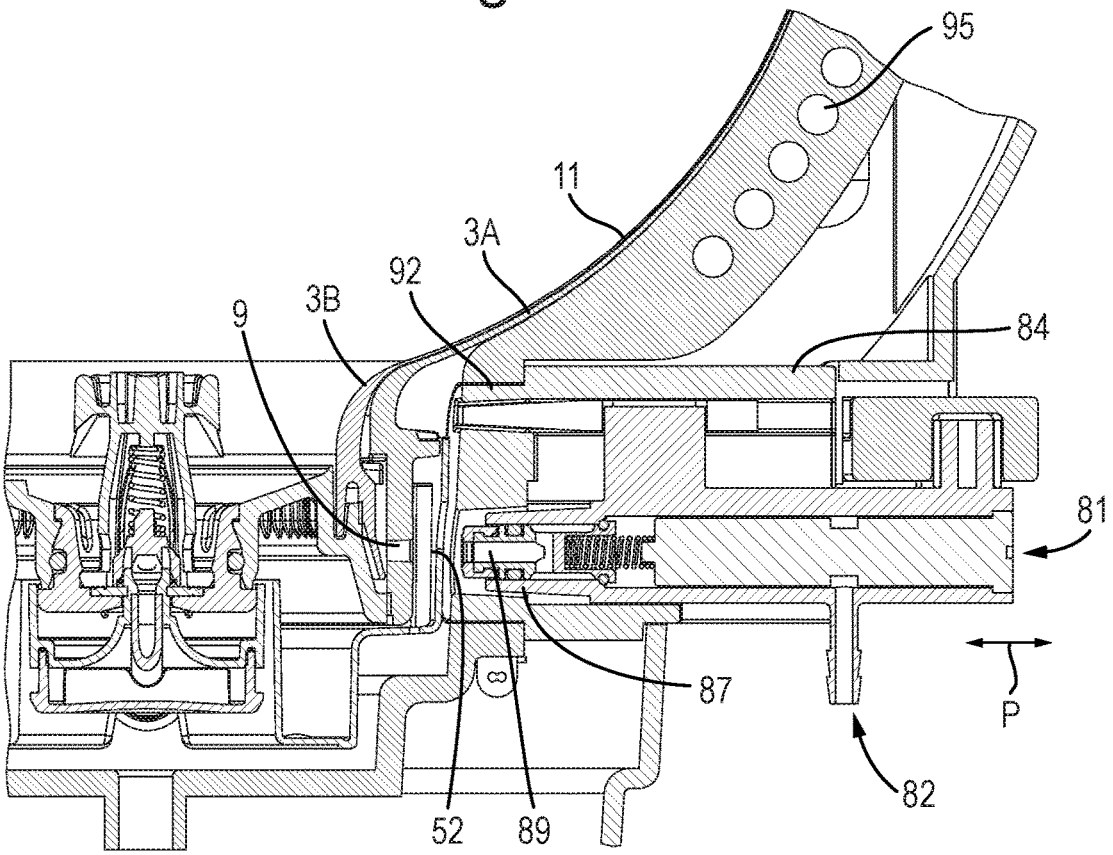
Figure 12:
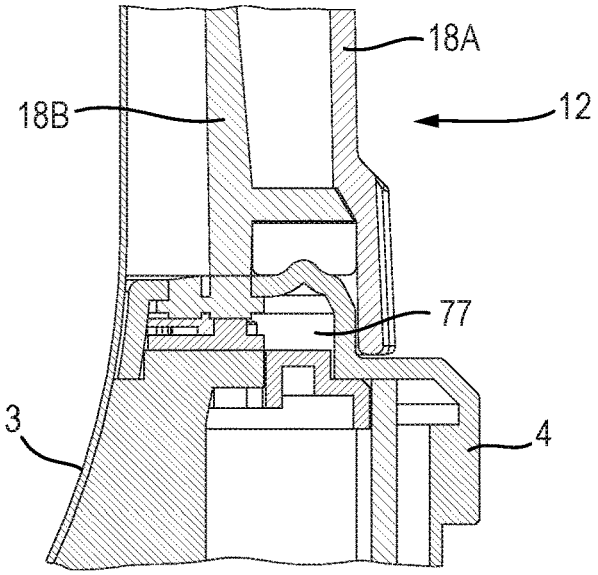
Figure 13:
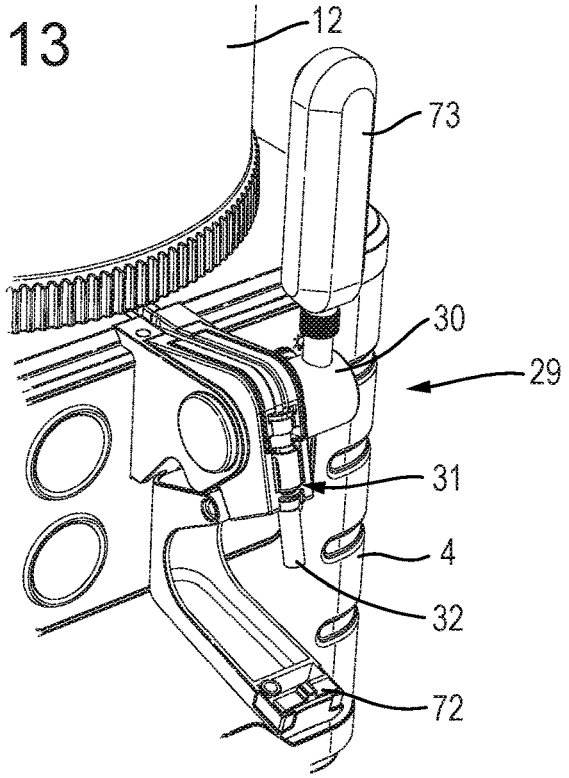
Figure 14:
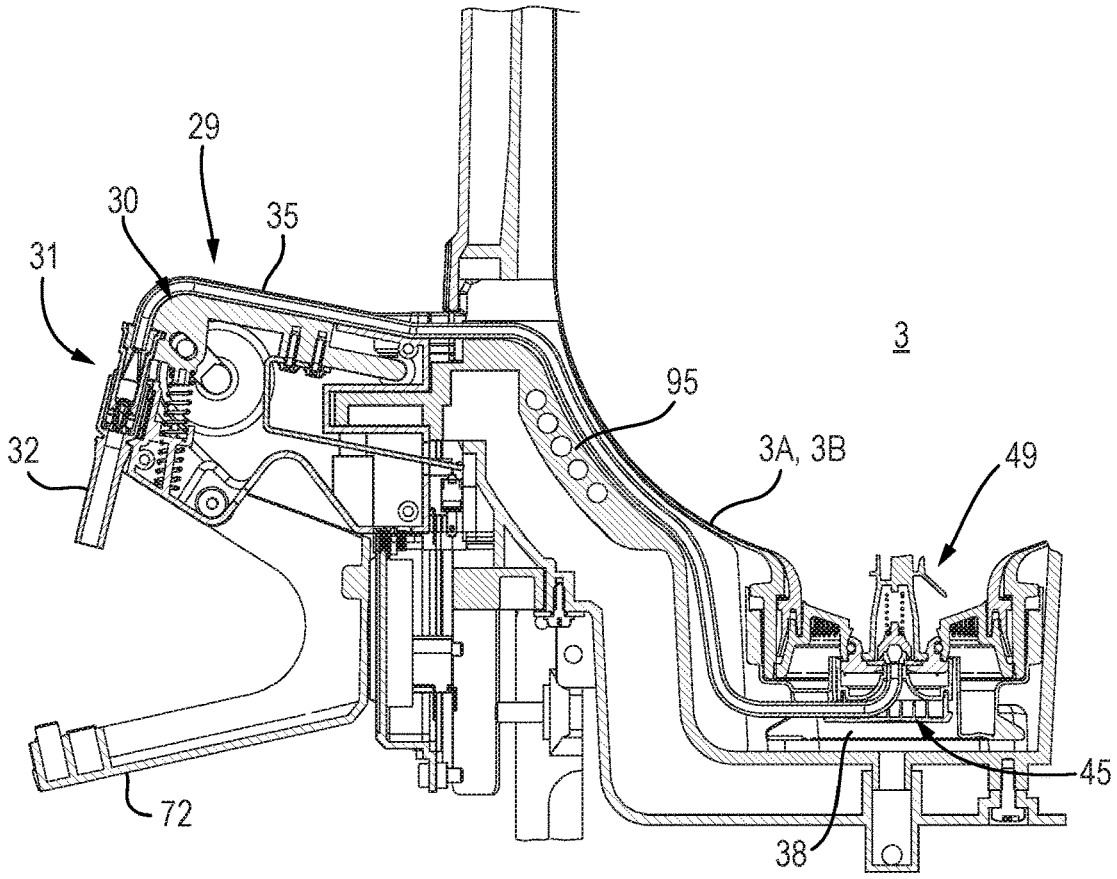
Figure 15:
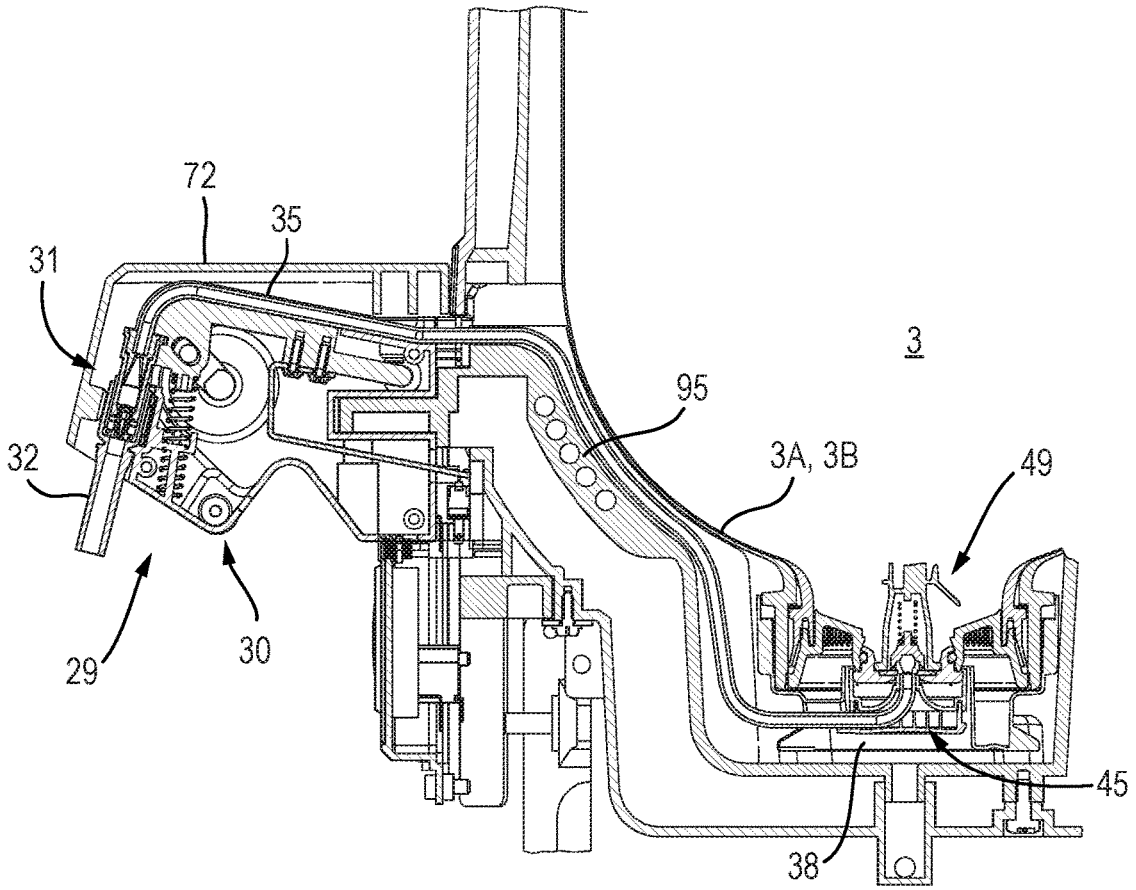
Figure 17:
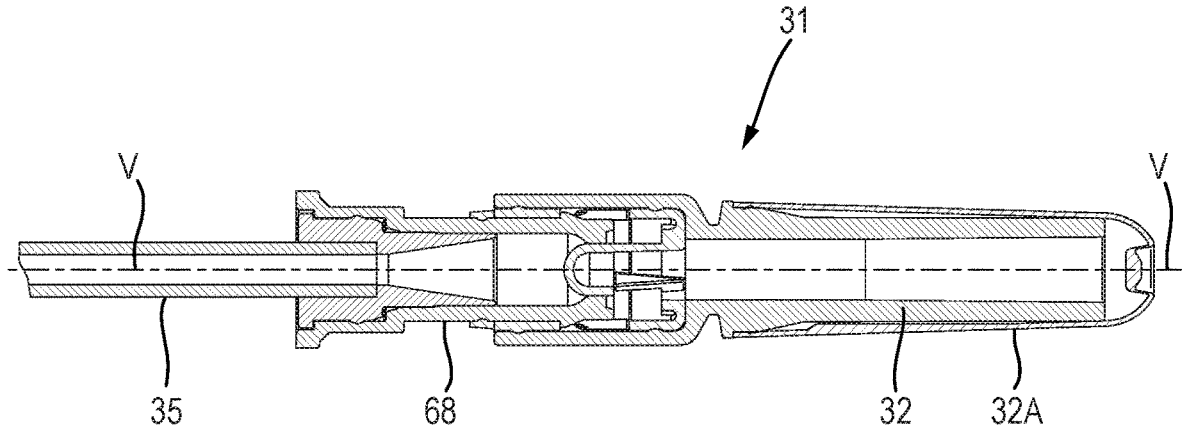
Figure 16A:
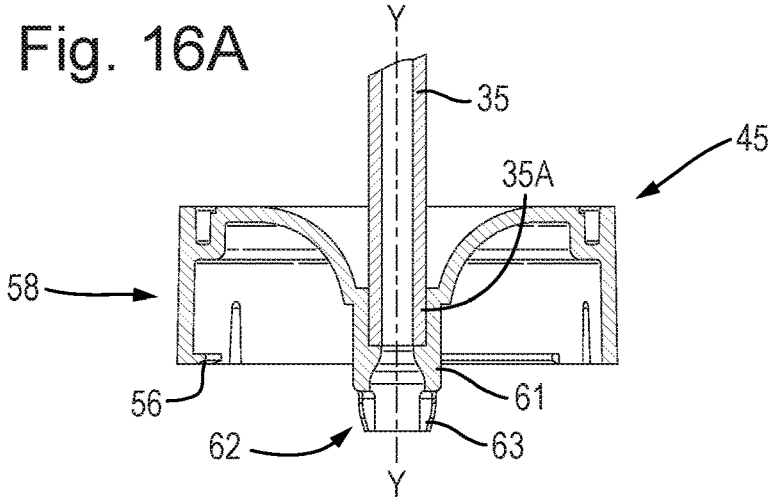
Figure 16B:
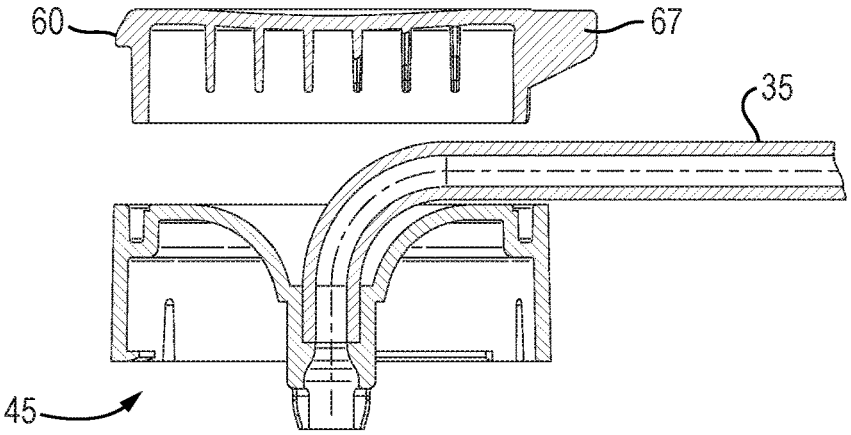
Figure 16C:
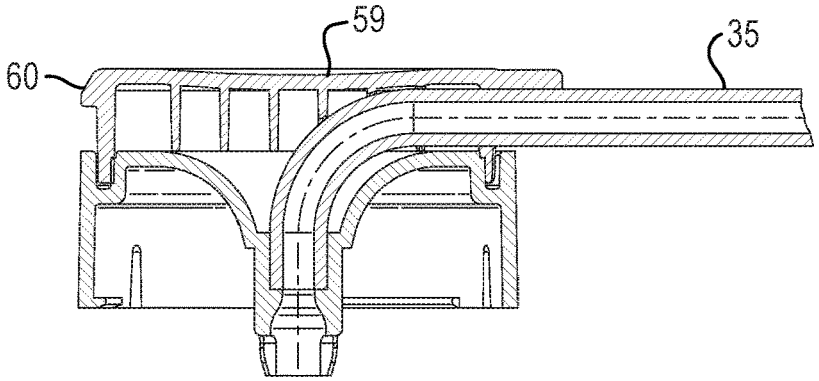
Figure 18:
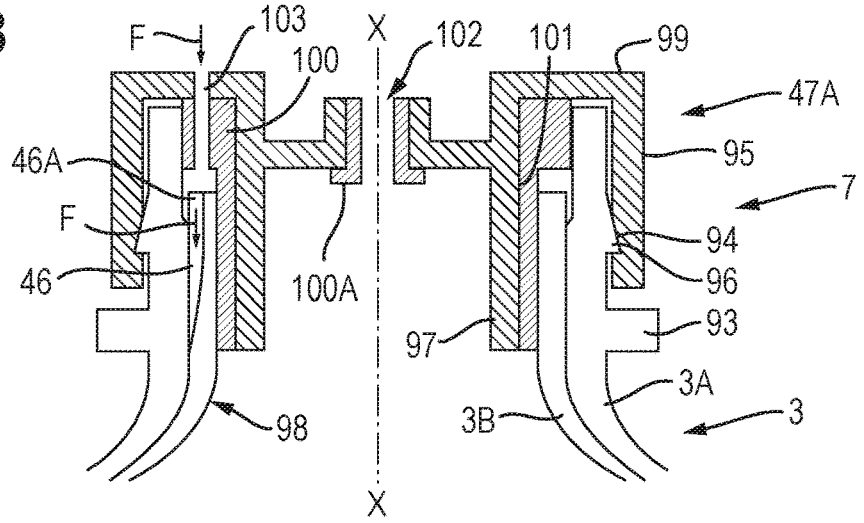
Figure 19:
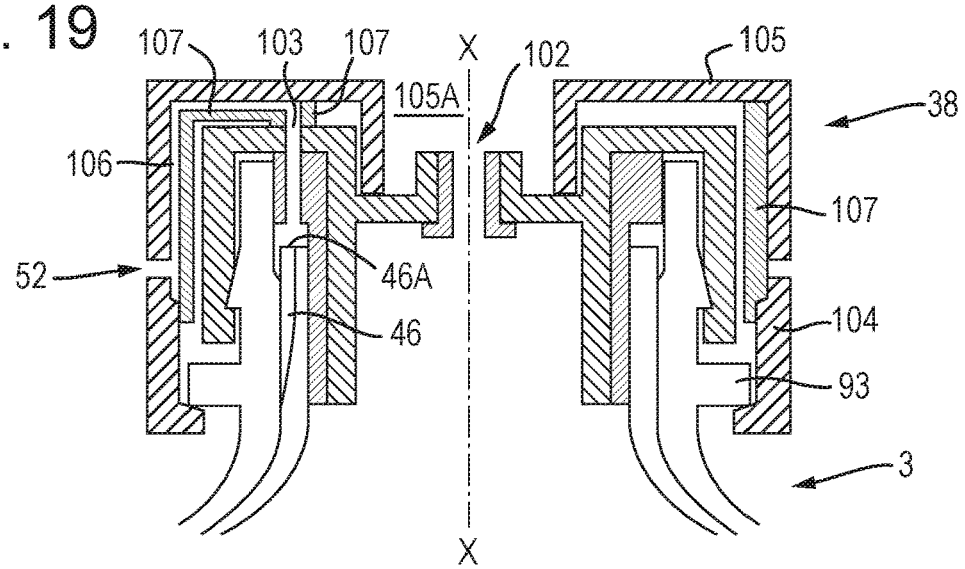
Figure 20:
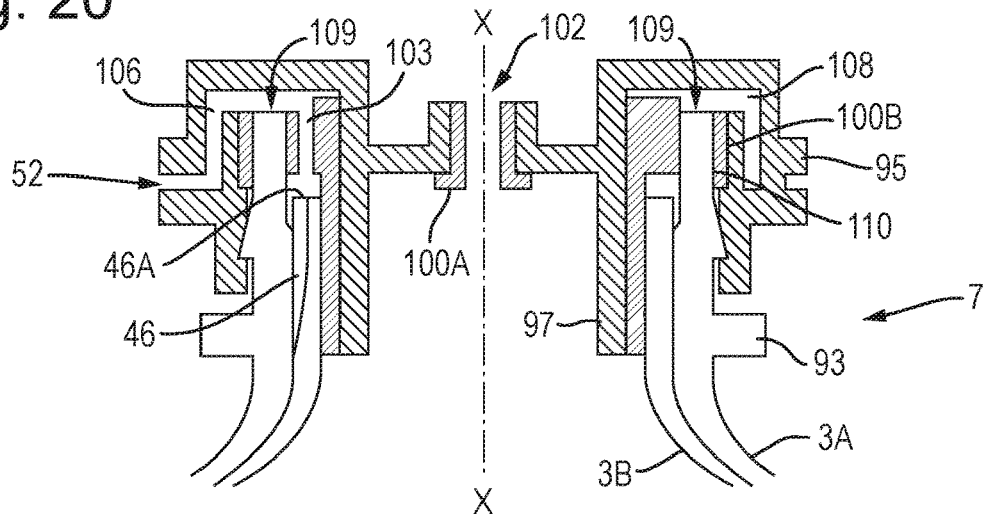

In order to further elucidate the present invention, embodiments thereof shall be disclosed and discussed hereafter, with reference to the drawings. Therein shows:

FIG. 1 a beverage dispensing assembly in a rear view, that is from a side of operating the dispensing assembly, with a branded container visible through a lid;

FIG. 1A a representation of a side view of an assembly of FIG. 1;

FIGS. 2A and B perspective views of an assembly of FIG. 1, in rear side view and front side view respectively;

FIGS. 3A and B a dispensing assembly according to the disclosure, in rear view and in cross sectional side view;

FIG. 4 an exploded view of a dispensing unit of an assembly for dispensing beverage;

FIG. 5 in eight steps schematically the use of a dispensing assembly of the disclosure;

FIG. 6A-D a neck portion comprising part of a container with an adapter, showing part of a dispensing unit comprising a dispensing line, both in perspective view and in cross sectional view, in a first embodiment;

FIG. 6E-G a neck portion comprising part of a container with an adapter, showing part of a dispensing unit comprising a dispensing line, both in perspective view and in cross sectional view, in a second embodiment;

FIG. 6H in perspective view a neck portion of an embodiment of a container;

FIG. 7 schematically in cross section part of a container in a receptacle of a housing of a dispensing unit;

FIG. 8 schematically in cross section a neck portion of a container with an adjacent shoulder part, positioned in a housing, especially a receptacle;

FIG. 9 in end view schematically an adapter for fitting on a container;

FIG. 10 in perspective view part of an indentation at the lower end of the receptacle, showing gas connectors and part of an operating mechanism thereof;

FIG. 11 in cross section part of a container in said receptacle and indentation, showing an air connector in an extended position;

FIG. 12 schematically part of a housing and lid, with a light source, e.g. a LED with a light guide;

FIG. 13 schematically a tap in cooperation with an inline valve of a dispensing unit;

FIGS. 14 and 15 schematically in cross section part of a housing with a tap with dispensing unit, with the tap in closed and in open position respectively;

FIG. 16A-C in cross sectional side view a dispense adapter with part of a dispense line, in straight (FIG. 16A) and in bent condition (FIG. 16B), and a cover for placing over the adapter, as shown in FIG. 16C;

FIG. 17 an inline valve mounted to a dispense line of a dispensing unit; and FIG. 18-20 relevant parts of alternative embodiments of containers with adapters or closures for use in a system according to the disclosure.

In this description embodiments are shown and disclosed of the invention, by way of example only. These should by no means be interpreted or understood as limiting the scope of the present invention in any way. In this description the same or similar elements are indicated by the same or similar reference signs. In this description embodiments of the present invention shall be discussed with reference to carbonated beverages, especially beer. However, other beverages could also be used in the present invention.

In this description references to above and below, top and bottom and the like shall be considered, unless specifically stipulated differently, to a normal orientation of a dispensing unit. The rear of the dispensing unit shall be referred to as the side at which a tap handle or the like is provided for operating the system, especially for operating for dispensing beverage contained in a container provided in and/or on the unit. The container can have a bottom part and a neck region comprising an orifice for filling and/or dispensing, the orifice within the assembly facing substantially downward. This is for example shown in the drawings, especially FIG. 1, wherein top, bottom, up and down are indicated by arrows and appropriate wording, for indicative purposes only. This does not necessarily reflect the orientation in which a tapping device of the present disclosure or parts thereof have to be used. For the container a normal position may be with a bottom portion facing down, a neck portion facing up. In a tapping assembly of the disclosure the bottom of the container may be facing up.

In this description a BIC type or bag-in-container type container has to be understood as meaning at least a container comprising an outer holder and an inner holder, wherein the inner holder is designed to hold a beverage and is more flexible or compressible than the outer holder. The outer holder can for example be a container, such as a bottle shaped container with a neck and a body, whereas the inner holder can be a flexible container, such as a bag. The inner and/or outer holder can be made of mono materials or blends, can be made entirely or partly by injection moulding and/or blow moulding, rotation moulding or the like. Preferably a bag-in-container according to the invention is made by integrally blow moulding. In embodiments the bag-in-container can be made by inserting at least one preform into another preform and then blow moulding them together into a bag-in-container type container. In embodiments the bag-in-container can be made by over-moulding at least one preform forming a multi layered preform and then blow moulding them together into a bag-in-container type container. In embodiments a bag can be suspended inside an outer container, after forming the outer container and the bag separately, at least in part.

In the present disclosure by way of example a bag in container (BIC) shall be described, integrally blow moulded from a preform set comprising two plastic preforms, super imposed, which should be understood as meaning that one of the preforms is inserted into the other, after which they are together blow moulded in a known manner into a BIC. In embodiments prior to said blow moulding a closure ring is fitted over the preforms, connecting them together and closing off the space, which can also be referred to as interface or inter space, between the preforms, such that at least after blow moulding said space is or can be in communication with the environment only through one or more openings provided in a neck region of the container, especially an outward opening, extending through a wall of the neck region of the outer preform and/or container. The said at least one opening can be provided during manufacturing the preforms, especially during injection moulding thereof, but could also be provided later, for example by punching, drilling or otherwise machining into the container, during or after blow moulding.

In this description a tapping assembly can comprise a housing holding a cooling device and a pressure device for supplying pressurized gas, such as air, to a container. The container can be a plastic beverage container, preferably a BIC type container. The system can further comprise a lid, preferably an at least partly transparent lid, fitting over the container when properly placed in the housing. The lid can provide visibility of the container within the dispensing device comprising the housing and the lid, such that for example the filling level can be ascertained and branding of the container is visible from the outside. Transparent should be understood in this context as being sufficiently clear to allow viewing and inspection of the container through the lid, preferably undisturbed by for example coloring or hazing of the lid over at least a substantial part of the lid, for example more than 50% of its surface area and/or from at least two opposite sides and/or over at least part of the lids' height over 360 degrees, i.e. from all sides. Providing visibility of the container and, especially at least branding thereof, can be beneficial for allowing different brands to be used in the same system without having to rebrand the dispensing unit. Providing visibility of the container and, especially at least branding thereof, can be beneficial for outward appearances of the dispensing unit. Providing visibility of the container and, especially at least branding thereof, can be beneficial for inspection of the container and/or it's contents.

In this description a dispensing assembly can be placed on a top of a bar or table or the like, such that a part of the container extending above the housing is at about eye level for an average adult person standing at the bar. The part extending above the housing preferably is visible from at least two opposite sides, such as from in front of and behind such bar.

In this description a dispensing assembly, which can also be referred to as tapping assembly can be designed such that a container can be placed in an "upside down" position on and/or into a housing of a dispensing unit, such that at least part of the container, especially at least part of a shoulder part of the container is introduced in a receptacle on the housing, a neck portion comprising an outflow opening facing down. Preferably a part of the container extending into said receptacle, especially part of the shoulder portion, is close to or at least in part in contact with a wall of the receptacle, wherein the wall of the receptacle is cooled, especially actively cooled. In this description relatively close regarding a distance between the wall of the receptacle and the relevant container part should be understood as a distance small enough to allow efficient cooling of the said part of the container and its content. In such embodiment the advantage is obtained that the content of the container will at least be in the area which is cooled by the wall of the receptacle, even if the container is partly empty, which cooled content is close to and especially directly adjacent the outflow opening. Thus control of the temperature of the beverage dispensed is very well possible, even if a part of the container extending outside the receptacle is not or less cooled.

In positioning the container in the receptacle preferably at least one line contact is obtained between the container and the wall of the receptacle, for contact cooling. Such line contact can for example be formed by a circle or elliptic line. Preferably over a relatively large part of the shoulder portion of the container extending inside the receptacle contact is established or at least a close proximity of the wall of the container relative to the wall of the receptacle. A distance between the relevant part of the container and the receptacle is preferably between 0 and 1 mm, measured as the smallest distance between adjacent surfaces, more preferably between 0 and 0.5 mm, even more preferably between 0 and 0.25 mm on average over at least part of a circumferential surface area of the receptacle having a height measure along a vertical axis of the receptacle which may for example be at least about $\frac{1}{4}^{th}$ of the height of the part of the container extending in said receptacle, for example at least about a quarter of the axial height of the shoulder portion of a container extending into said receptacle, measured directly adjacent the neck portion.

Figure 3B:
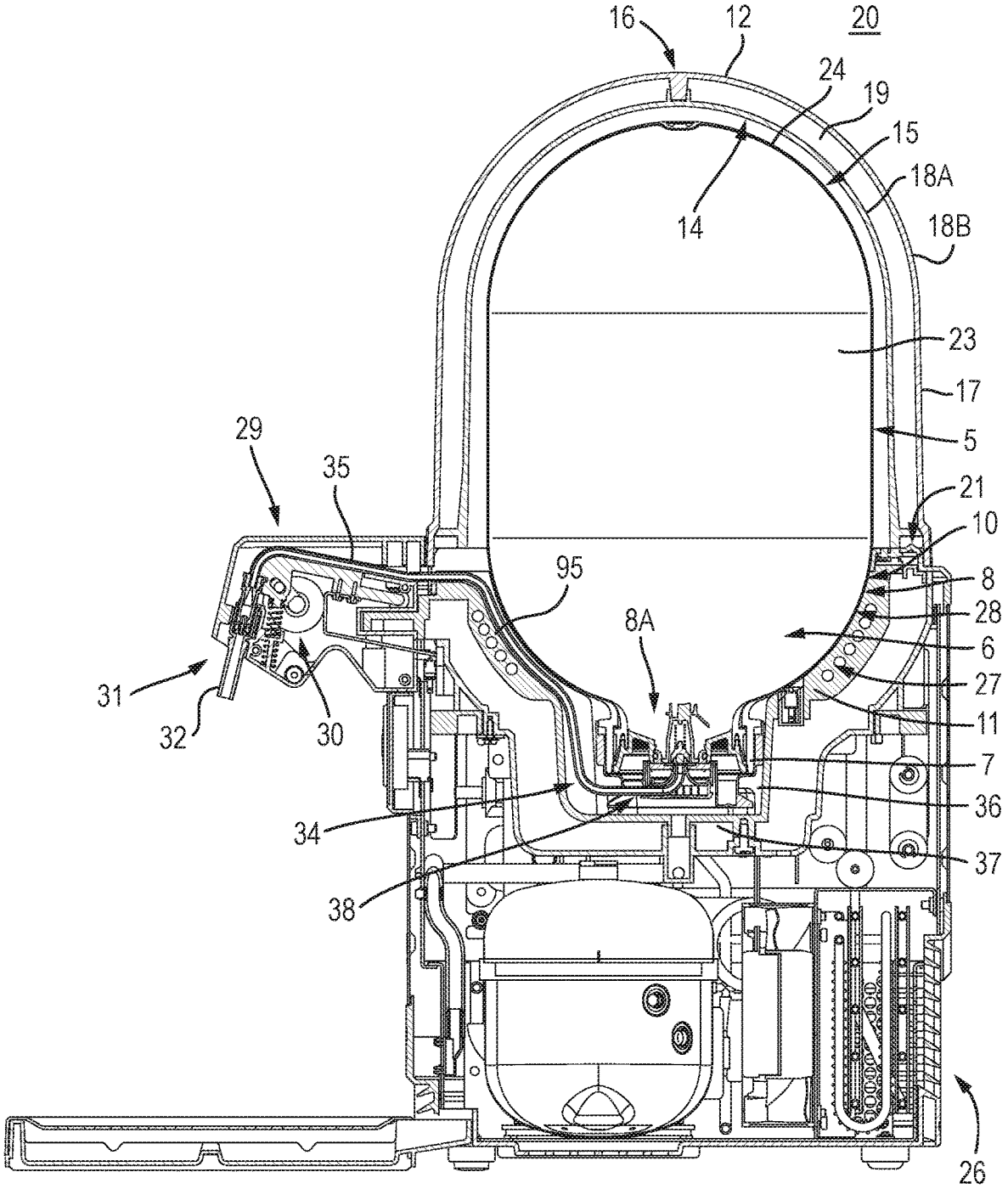

FIGS. 1 and 1A show an exemplary embodiment of a beverage dispensing assembly 1 of the disclosure, comprising a dispenser 2 and a beverage container 3. The dispenser 2 can also be referred to as for example unit, dispensing unit, tapping device or similar wording. The dispenser 2 comprises a housing 4. The housing 4 is provided with a receptacle 5 for receiving at least part 6 of the container 3. The beverage container 3 has a neck portion 7 and a shoulder portion 8 adjacent the neck portion 7. The neck portion 7 is provided with at least an outflow opening 8A and at least one gas inlet opening 9 (see e.g. FIGS. 3, 6 and 10). In the embodiments disclosed the container can be a blow molded plastic container 3, preferably a Bag-in-Container (BIC) type container. The container 3 is positioned in the dispenser 2 with the neck portion 7 and shoulder portion 8 facing downward, such that the neck portion 7 and at least part of the shoulder portion 8 are received in the receptacle 5. A part 10 of the shoulder portion 8 extends close to and/or is in contact with a wall 11 of the receptacle 5 (e.g. FIG. 8).

The dispensing assembly 1 is by way of example placed on a top 75 of a bar 74, such that the part 13 of the container 3 extending above the housing 4 and, if present, a lid 12 are at about eye level for an average adult person, in FIG. 1 indicated symbolically by eye 76. The top 75 of the bar can for example be, but is by no means limited to, at about 100 to 130 cm at a front side available for customers. By placing the tapping assembly 1 on a bar 74, visible for at least customers standing or sitting at the bar and preferably customers standing or sitting at the bar and personnel, standing behind the bar, the visibility of the system and especially of the relevant part 13 of the container is increased. Especially when branding 22 has been provided on said part 13 of the container 3 this will increase the appeal of the system 1 and especially of the beverage enclosed within said container 3. It has been found that this appeal will increase sales of the beverage and moreover may increase the appeal of the bar. Preferably a lid is provided over the part 13 of the container, which is sufficiently transparent to provide a view of the container part 13 from at least the front and behind of the bar 74, i.e. for customers and bar personnel, and preferably provides for a view of the container part 13 over about 360 degrees. A top part of the lid 12 could be less transparent, for example opaque.

The container 3 is preferably substantially barrel or bottle shaped, having said neck portion 7 and shoulder portion 8 and further having a body portion 23 and a bottom portion 24. The bottom portion may have any suitable shape and in the embodiment shown is substantially spherical, more specifically substantially a hemisphere. Alternatively it can for example be shaped such that the container can stand on said bottom portion 24, for example petal shaped.

In the embodiments as shown a lid 12 is provided over the container 3, enclosing a part 13 of the container 3 extending outside the receptacle 5. However, the assembly can in embodiments also be operated without a lid 12. The lid 12 can be substantially dome shaped, at least to such extend that it has an inner surface 14 extending along the outer surface of the part 13 of the container 3 extending outside the housing 4, preferably at a substantially regular, equal distance. This may provide for a space 15 between said inner surface 14 of the lid 12 and the outer surface portion of the container. In embodiments the lid can have a top 16 which is substantially spherical and a body portion 17 which is preferably substantially cylindrical. The lid 12 may be made of plastic, preferably transparent plastic, such that the container 3 can be observed through at least part of the lid 12. In embodiments the lid 12 can be double walled, having an inner and an outer wall 18A, B, and a space 19 enclosed there between, preferably isolated from the surroundings thereof, such as the area 20 in which the assembly is positioned and the space 15. In embodiments the space 19 can be at a pressure lower than the pressure inside the area 20 and/or space 15, and can for example be sucked vacuum, in order to lower the heat transmissibility of the lid 12. In embodiments the lid 12 can rest on a seal 21 of the housing 4 and/or can be provided with a seal 21 for resting on the housing 4, such that the space 15 is isolated from the area 20 once the lid 12 has been properly placed on and/or in and/or over the housing. In embodiments this can provide for a substantially stagnant layer of air in said space 15. In other embodiments a fan or similar means can be provided for providing an air flow of preferably cooled air through said space 15 for cooling the container and the beverage contained therein. The lid can also be made partly or entirely of glass or metal.

In preferred embodiments the container 3 is provided with branding 22, at least on the part 13 of the container 3 extending outside the housing 4. Said branding 22 is preferably provided such that at least part of it is provided in an upside down orientation when the container 3 is placed on its bottom 24. Thus when the container 3 is placed in an upside down position in the dispenser 2, the neck portion 7 facing down, the branding is in the proper orientation for readability and visibility.

In the embodiment shown in e.g. FIGS. 1 and 1A, 3 and 3A the housing 4 comprises a cooling device 26 for cooling at least a part 27 of the wall 11 of the receptacle 5. The receptacle 5 and cooling device 26 are preferably designed for contact cooling of a part 28 of at least the shoulder portion 8 of the container 3. As is clear from the exemplary embodiments this will lead to cooling of at least the beverage close to the neck portion 7 from which the beverage will be dispensed, this beverage thus being cooled at a desired temperature. The cooling of the receptacle can be provided for by any suitable means, such as a compressor based cooling device, a piezo based cooling device, ice cube cooling, liquid cooling or the like systems as known in the art. By way of example a compressor based cooling device 26 will be described, as an advantageous embodiment.

The container 3 in the embodiments as shown is provided with a dispensing unit 34 including at least a dispensing line 35 for dispensing the beverage. The housing 4 comprises a tap 29 for connecting to and/or cooperating with the dispensing line 35, for opening and/or closing the dispensing line 35. The dispensing line is preferably a disposable line, which should be understood as meaning that it is designed and intended for limited use, for example with only one container 3 or a limited number of containers. Preferably the dispensing unit 34 is designed such that the container 3 can be broached with it, after which the dispensing unit 34 and/or the dispensing line 35 cannot be removed again, without damage to the unit 34 and/or container 3.

In preferred embodiments the tap 29 comprises an operating mechanism 30 for opening and/or closing a valve 31 provided in the dispensing unit 2, especially a valve provided in or at an end of the dispensing line 35. Such is for example shown in more detail in FIGS. 13-17. The dispensing line 35 can be made of plastic and can be flexible, such that it can be bent as shown. The valve 31 is fixedly connected to the tapping line 35, such that it is placed and removed, i.e. exchanged together with the dispensing line 35. The valve 31 can have a spout 32 extending outside the housing 4, such that the spout 32 is the last point of contact for the beverage to be dispensed. By providing such valve 31 which is disposable contact between the beverage and the further dispensing assembly 1 can be prevented. Thus cleaning of the dispensing assembly has to be cleaned less frequently.

Alternatively other means for opening and/or closing the dispensing line 35 can be provided for, such as but not limited to means for squeezing the tapping line shut. A permanent valve can be used as part of the tapping device 2, to which the tapping line 35 can be connected when placing the container. Alternatively or additionally the tapping line can be permanent or semi permanent, wherein the container, especially an adapter 38 as discussed can be connected to said tapping line.

As can for example be seen from FIG. 3A an B and FIGS. 8 and 11 the receptacle 5 can or example be substantially bowl shaped, for example semi spherical, such that the container 3 can be supported by the wall 11 of said receptacle 5 by at least part of the shoulder portion 8. Preferably in close contact for contact cooling. At a lower end of the receptacle 5 an indentation 36 can be provided for receiving the neck portion 7 of the container, with the dispensing unit 34 or at least part thereof provided on the neck 7. In embodiments the indentation 36 can be such that the neck 7 and/or dispensing unit 34 do not rest on a bottom 37 of the indentation 36.

As can be seen in for example FIG. 6A-G the dispensing unit 34 can comprise an adapter 38 which is or can be fixed onto the neck 7 of the container, for example form locked, press fit, screwed, fitted by cooperating bayonet fitting elements or the like, or welded or glued. The adapter 38 can have an end face 39 and can have a non-circular, or more general preferably a non-rotational symmetric configuration when viewed in a direction along a longitudinal axis X-X of the container 3 or at least the neck 7 thereof. In the embodiment shown the adapter 38 has two wings 40, 41, extending from opposite sides, having different configurations. In the embodiments shown by way of example a first wing 40 has a smaller width $W_{40}$ than the width $W_{41}$ of the second wing 41. The second wing 41 has a slit 42 extending there through, through which the dispense line 35 can extend. FIG. 9 shows a schematic view along the axis X-X of an adapter 38 within the indentation 36. As can be seen the indentation 36 is provided with a configuration compatible with the configuration of the unit 34, especially the wings 40, 41, such that the adapter 38 can be positioned inside the indentation only in one orientation, due to it being non-rotational symmetric. As can for example be seen in FIG. 10 in perspective view to this end two curved wall elements or raised portions 43 are provided along opposite edges of the indentation 36 (one thereof being visible in FIG. 10) between which the adapter body 38A can be fitted, the wings 40, 41 positioned between opposite ends 43A, B thereof. Thus when positioning the container 3 in the receptacle will automatically be correct by proper positioning of the wings 40, 41. When not properly positioned the container 3 cannot be lowered far enough to properly be supported within the receptacle 5 and if a lid is provided this will not properly fit over the container 3. Moreover the dispensing line 35 will be out of position and the gas connections as will be discussed will not properly align.

As can be seen schematically in FIGS. 6A-G, 7-9 and 11 a container 3 can be a BIC type container having an outer container 3A and an inner container or bag 3B, preferably more flexible than the outer container 3A. The inner and outer container 3A, 3B can be connected to each other by a closure ring 47 fitted to, preferably permanently fixed and more preferably welded to the containers 3A, 3B, such that a space 46 between the inner and outer container 3A, 3B is closed off by said closure ring. The closure ring 47 has a central opening 48 in which a valve 49 has been mounted. The general design and configuration of a container 3 as disclosed in and to be used with a system of this description can for example be as is described in EP2413762, EP2405517, EP2920080, EP2882679, EP2882680, EP2885241, EP2885242, enclosed herein by reference with respect to the configuration of the container, including but not limited to methods of manufacturing the same and materials used. In all of these embodiments of containers at least one opening 9 is provided in a neck region 7 of the container, extending through a peripheral wall portion 7A of the neck 7, especially a neck portion of the outer container 3A, and opening into or at least connected to the space 46, such that during use a gas under pressure can be introduced into the space 46 for compressing the inner container 3B for dispensing the beverage.

FIG. 6H shows by way of example a neck portion 7 of a container 3 as disclosed in the prior art as mentioned here above. The closure ring 47 has been welded to the inner and outer container 3A, 3B, for example spin welded, but could be fitted in any suitable way, removable or, preferably, non removable, meaning that it cannot be removed without damage to the ring 47 and/or inner and/or outer container 3A, 3B. In FIG. 6H one opening 9 is visible. There can be two such openings 9, preferably diametrically opposite each other. On either side of the opening 9 a coupling element 50 can be provided for coupling with appropriate contra coupling provisions of the adapter 38. For example the contra coupling provisions could be formed or could comprise a snap ring 51 which can snap over and/or behind the coupling elements 50, locking the adapter in position. Preferably the counter coupling provisions are designed for allowing the adapter 38 to be positioned onto the neck 7 in only one position, or in two positions, rotated relative to each other over 180 degrees around the axis X-X. In this embodiment the opening or openings 9 extends substantially radially, through a wall of the neck 7 of the outer container 3A. A valve 49 is provided substantially central, which in this embodiment can be a clinched aerosol type valve.

Alternatively the container 3 could be made differently, for example but not limited to according to US2008/0257883. In FIG. 18-20 alternative embodiments of containers 3 are shown, at least their neck portions 7, suitable for use in the present invention.

In FIGS. 18-20 a neck portion 7 of a BIC type container 3 is shown, having an outer container 3A and an inner container 3B. In each of these embodiments at least one air inlet 46A is provided into the space 46 between the outer and inner containers 3A, 3B. The inlet 46A has a main direction of flow F substantially parallel to a longitudinal axis X-X of the container 3 or at least of the neck portion 7, i.e. extending substantially in an axial direction. The container can again be made by blow moulding, for example integral stretch blow moulding from a multi layered preform or a preform assembly, for example made from PET, PEN or PEF or blends comprising one or more of such crystalline or semi crystalline plastic materials.

In FIG. 18 a closure 47A is mounted to the neck 7, for example similar to that as disclosed in EP2238041. The closure can for example be mounted in a manner similar to a ring 47 as discussed previously. In this embodiment the closure 47A is clicked onto the neck portion by a groove 94 in an outer portion 95 of the closure 47A gripping behind a retention ring or stubs or the like connecting elements 96, which prevents the closure 47A from being removed, preferably such that the closure 47A cannot be removed without damage to the closure 47A and/or the neck portion 7. Alternative mounting provisions can be used, such as but not limited to screw threads, bayonet elements, welding, press fitting or any such suitable means as known in the art. The closure 47 has an inner portion 97 fitting against an inner surface 98 of the neck of the inner container 3B, and is connected to or integral with the outer portion 95 by an end portion 99. In the embodiment shown a sealing layer 100 is provided, for example by 2K moulding, sealing against said surface 98. Said sealing layer 100 also seals against an inner surface 101 of the outer container 3A.

Central to the end portion 99 a beverage outflow opening 102 is provided, which in this embodiment is shown as an open outflow opening 102 with a sealing ring 100A. In embodiments a valve 49 can be mounted in or over the opening 102, for example as previously discussed, connected to or in stead of the sealing ring 100A. In embodiments a pierceable closure can be provided in or over said opening 102, for example as disclosed in EP2238041. In embodiments a dispense line 35 with a valve 31 can be connected to said opening, directly or indirectly, for example by a dispense adapter 45, similar to that as previously discussed.

Spaced apart from the beverage opening 102 an inlet opening 103 is provided, for introducing a pressure fluid, especially a gas such as air or $CO_2$, into the inlet 46A to be introduced into the space 46, for compressing the inner container 3B. Said inlet opening 102 again has a main direction of flow F which is substantially parallel to the axis X-X and the main direction of flow F of the inlet 46A.

In FIG. 19 the neck portion 7 of FIG. 18 is shown, wherein an adapter 38 is mounted over the closure 47A. In the embodiment shown the adapter has an outer skirt or flange 104 which can hook behind a ring or flange 93 of the container 3. An end face 105 is provided with a central opening 105A allowing access to the outflow opening 102. The outer skirt 104 is provided with at least one opening 52 which extends substantially radially through said skirt 102, into a channel 106 connecting said at least one opening 52 to the inlet opening 103. Appropriate seals 107 are provided for sealing the channel 106 such that a pressure fluid introduced through said opening 52 can be fed into the inlet opening 103 without leaking.

In preferred embodiments the adapter 38 is configured on the outside substantially equal to the adapter 38 as discussed with reference to e.g. FIGS. 6A-G and 9, having the wings 40, 41 for fitting correctly and preferably in one orientation only inside the receptacle 5 and, especially, the indentation or receptacle 36, fitting between the raised portions 43, of a tapping device 1, such that a gas connector 53 of the tapping device 1 can connect to the said opening 52 in an appropriate way. Preferably also at least one blade 91 can properly engage the adapter 38 and/or ring 93 for positioning and/or locking the container and/or can be used for detecting the presence of a container 3.

In FIG. 20 in stead of an adapter 38 the closure 47A of the container is provided directly with the channel 106 extending between an opening 52 in an outer face 107 of the closure extending outside the container neck portion 7 and the inlet opening 46A into the space 46 between outer and inner containers 3A, 3B. In this embodiment the closure 47A can be substantially the same as that shown in FIGS. 18 and 19, but in this embodiment the outer portion 95 can comprise at least part of the channel 106. In the embodiment shown, by way of example only, the outer skirt 95 has an annular chamber 108 which extends over an upper edge 109 of the outer container 3A, wherein a seal 100B is provided sealing against an outer surface 110 of the outer container 3A adjacent said edge 109. The channel 106 extends at least partly through said chamber 108, again such that a gas connector 53 of the tapping device 1 can connect to the said opening 52 in an appropriate way.

In preferred embodiments the closure 47A is configured on the outside substantially equal to the adapter 38 as discussed with reference to e.g. FIGS. 6A-G and 9 or FIG. 19, having the wings 40, 41 for fitting correctly and preferably in one orientation only inside the receptacle 5 and, especially, the indentation or receptacle 36, fitting between the raised portions 43, of a tapping device 1, for defining the proper positioning for engagement with the at least one connector 53. Preferably also at least one blade 91 can properly engage the adapter 38 and/or ring 93 for positioning and/or locking the container and/or can be used for detecting the presence of a container 3.

In these embodiments of FIG. 18-20 again a dispense adapter 38 can be used as previously discussed, wherein the adapter 38 and/or the closure 47A can be provided with appropriate means for engagement with and retaining of the dispense adapter 45 in a position for opening a valve or piercing a pierceable closure and allowing beverage to be dispensed. As discussed, in all embodiments disclosed a dispense line 35 could also be coupled directly to the container, especially to a closure ring, to the valve 49 and/or to the outlet 102, without an intermediate dispense adapter 45.

In embodiments disclosed the valve 49 mounted in the closure ring 47 can for example be according to EP2917148 or EP2914542. The valve 49 has a valve body 49A which can be pushed away from a valve seat 49B in an axial direction, i.e. along or parallel to the axis X-X, further into the container 3, for opening the valve 49, and is biased in a closed position.

As can be seen in for example FIG. 6A-6G the adapter 38 can have a central opening 44 in which a connector, also referred to as dispense adapter 45 is provided or can be introduced. The dispense adapter 45 is connected to or connectable to the dispense line 35. In FIG. 6A the dispense adapter 45 is shown in a rest position, with the dispense line 35 wound around the adapter 38 under the wings 40, 41, for storage. In this position the container 3 can be stored and be delivered to a user. The dispense adapter is positioned such that the valve 49 is closed, as can be seen in FIG. 6B in cross section. A resilient finger or wall 55 clicks into the dispense adapter 45, for example below an edge 60, for aiding in retaining it in this position. In FIGS. 6C and D the same container 3 is shown, with the dispense line unwound, extending through the cut through 42, whereas the dispense adapter 45 has been pushed further into the adapter 38, opening the valve 49, as can be seen in FIG. 6D. The dispense adapter is preferably locked in this position, for example by the finger or wall 55 and/or by a part 56 of the dispense adapter 45 locking behind a clinch plate 57 of the valve or any suitable means. Alternatively or additionally a bulge (not shown) at the bottom of the indentation 36 could force the dispense adapter 45 into the position of FIGS. 6C and D or FIGS. 6F and G and/or keep it in that position, such that during use it does not close again. Thus beverage can flow into the dispense line, preferably no further than the valve 3 when closed. In this position the container can be turned up side down and placed inside the receptacle 5 and indentation 36.

FIG. 6E-6G show an alternative embodiment, in which in FIG. 6E the adapter 38 is shown mounted onto a container but without the dispense adapter 45 with dispensing line 35. This can be separately provided to the user. Prior to use the user will push the dispense adapter 45 into the opening of the adapter 38, the dispensing line 35 passing through slit 42, and opening the valve 49 as described.

FIGS. 16A-C and 17 disclose an example of a dispense adapter 45 with dispensing line 35, in partial cross section. In FIG. 16A a housing part 58 of the dispense adapter 45 is shown, with a hollow central shaft 61 extending along an axis Y-Y which, during use, will coincide with or at least be substantially parallel to the axis X-X. A free end 62 of the shaft 61 may be provided with a seal 63, for example rubber or silicon or such soft, resilient material, for sealing cooperation with the valve 49 when pushed into the opening 64 of the valve 49. At the opposite end 65 an end 35A of the dispensing line 35 can be fitted into the hollow shaft 61. Said end 65 connects to a sloping or curved surface 66 over which the dispensing line 35 can be bent, as shown in FIG. 16B, in order to include an angle, preferably of about 90 degrees in said end 35A of the dispensing line 35. Then a lid 67 can be fitted over the tapping line 35 and housing part 58, locking the dispensing line 35 in said angled position, as shown in FIG. 16C. As can be seen in FIG. 16 the lid 67 may comprise the edge 60. The lid 67 can be connected in any suitable way, for example by press fit, form lock, welding, gluing or any such means known to the skilled person.

FIG. 17 shows in cross section a valve, especially an in line valve 31 with a spout 32, covered by a cover 32A which can be removed prior to use, and will keep the spout 32 clean until such use. The valve 31 is connected to the dispense line 35 opposite the end 35A connected to the dispense adapter 45, and can have a construction and design as known from for example the David system as marketed by Heineken®. The spout 32 can be movable relative to a body 68 in a substantially longitudinal direction, along an axis V-V of the spout, for opening and closing the valve 31.

As can be seen in e.g. FIG. 10 the indentation 36 can be provided in a lower part 4A of the housing 4, above which the receptacle or at least the further receptacle 5 can be provided, in a further housing part 4B. The indentation 36 has in a wall part 68 between two ends 43A of the raised portions 43 a channel 69 in which the dispense line 35 can be positioned when the container 3 is placed properly in the tapping device 1. In FIGS. 14 and 15 it is shown how the dispense line 35 is the led further up through an adjoining channel 69 extending in the wall 11 of the receptacle upward, such that it is kept out of interfering with the close proximity and preferably contacting of the said wall 11 and the shoulder portion 8 of the container 3. As indicated before the tapping assembly, especially the dispenser 2 comprises an mechanism 30 for opening and/or closing a valve 31, when properly placed. To that end the operating mechanism has a holding element 70 for holding the body 68 of the valve 31 and a grabbing element 71 movable relative to the holding element 70, for grabbing and moving the spout 32 between the opening and closing position of the valve 31. A tapping handle 73 is directly or indirectly connecting to the grabbing element 71 for moving it between said positions.

FIG. 14 shows a position of the operating mechanism 30 in which the valve 31 can be positioned or removed. The tapping handle may have been removed and a lid 72 has been opened, allowing access to the grabbing and holding element for placing or removing the valve 31. This position is shown in FIG. 13 in perspective view. Then the lid 72 can be closed again, over the valve 31 and dispensing line 35, as shown in FIG. 15, and the handle 73 can be replaced, if necessary.

As can be seen in FIGS. 10 and 11 the housing comprises an operating mechanism 80 for operating the at least one gas connector 53 of the tapping device 1. The operating mechanism 80 is especially designed for moving at least one gas connector 53 between a retracted position and an extending position, extending at least partly radially into the indentation 36, to connect to the gas inlet 52 provided in the adapter 38 connecting to the opening 9 of the container 3 or a vent thereof. In the embodiment shown two such gas connectors 53 are provided, at opposite sides of the indentation 36, i.e. radially opposite to each other. However one such connector could be sufficient. One of the connectors 53 can in embodiments be used for introduction of gas, especially air, under pressure into the container, especially into a space 46 thereof, through gas inlet 52 of the adapter and the opening 9 or vent. In embodiments one connector 53 could be provided for pressure release of the container 3, especially the space 46, if the pressure would rise above a predetermined level, for example by connecting said connector 53 to an over pressure valve. In embodiments one such connector 53 could be connected to a pressure sensor (not shown) for sensing presence of a proper container or at least proper connection thereof. In embodiments another type or position of a sensor for sensing presence of a container can be used, for example a pressure switch, a position switch, an optical sensor or any such sensors known in the art.

In the embodiment shown the or each connector 53 is carried by a slider 81 which is slidingly supported in the housing 4, such that it can slide radially back and forth in the direction as indicated by the double headed arrow P (FIG. 11). A gas inlet 82 is provided for connecting to a compressor or pump 83 or other source of compressed gas, especially air. A ring 84 is mounted in the housing 4, extending around the receptacle 36, which has at least one and in the embodiment shown two guide slits 85, in each of which a pin 86 of one of the sliders 81 extends. The slits 85 extend such that rotation of the ring 84 around a vertical axis parallel to or coinciding with the axis X-X will push the sliders 81 simultaneously into the extended position or away from said extended position into a retracted position. The ring 84 could be made to be rotated by hand or by rotation of the container. In the embodiment shown the ring 84 is operated and rotated by a motor 89 through a pinion 87 engaging teethed a rack portion 88 of the ring 84.

FIG. 10 shows the retracted position of the slider or sliders 81. In this position a forward end 87 of each slider 81 is close to or substantially flush with a wall 36A of the indentation 36, such that the adapter 38 can easily enter into or be removed from the indentation 36 and thus from the tapping device 2. In an extended position the forward end 87 of the slider 81 will be forced against an outer wall part of the adapter 38 and/or into an inlet 52, for connecting the slider 81 and especially a nozzle 90 thereof extending from or provided by the forward end 87 into fluid communication with the said inlet 52 and/or opening 9. In this position gas, especially air, can be introduced into the container from the gas inlet 82 provided by said source such as a compressor or pump.

In embodiments shown to at least one slider 81 a blade 91 is connected which can move alone with said slider 81. A forward end 92 of such blade 91 can be brought into an extended position, along with the slider 81, such that the forward end 92 is forced above a ring 93 provided on the neck of the container 3, i.e. at a side of said ring 93 opposite the side of the closure ring 47. This can aid in preventing that the container 3 can be removed while the slider(s) is/are in the extended position. Moreover, in embodiments the blade or blades and ring 93 can be designed to push the container further down into the receptacle 5, in order to improve proximity or contact between the shoulder portion 8 of the container and the wall 11 of the receptacle 5, thus improving cooling. In embodiments a sensor can be attached to the slider or blade, such that when the slider and blade are moved to the extended position but do not encounter an adapter, they will give a warning signal or shut down the dispense device at least partly, for example by closing off air supply. Alternatively or additionally the sensor can switch on the device 2 or activate functions thereof when recognizing that a proper container is placed in a proper position.

As discussed a cooling system 26 is provided in the housing 4, here shown as a compressor and evaporator based cooling system, which has cooling lines 95 or the like extending in close proximity to or inside the wall 11 of the receptacle 5 and possibly the indentation 36, for cooling the wall 11 or at least a relevant part thereof. The cooling device 26 is preferably designed to keep the wall 11 at a predefined temperature, or at least to cool the wall such that at least the beverage close to the outlet opening, i.e. in the neck 7 and possibly the shoulder portion 8 at a desired temperature or as close as possible to it. Depending on the beverage and a users preference this temperature can preferably be set, for example but not limited to between about 4 and 9 degrees Celsius, for example around 6 degrees Celsius. Other temperatures or temperature ranges can be set.

As can be seen in e.g. FIGS. 3B, 7, 9, 11 and 13-15, the shoulder portion 8 of the container can fit to the wall 11 of the receptacle closely, whereas the inner container 3B in the shoulder portion can fit snugly along the inner surface of the outer container. Thus contact cooling between the wall 11 and the shoulder portion of the container 3 has surprisingly proven to be highly effective.

In a common fashion the tapping device 2 comprises a leak tray 102, below the spout 32 when properly placed. FIG. 4 shows an exploded view of a device 2 of the present disclosure, in an advantageous embodiment. However, it should be noted that many different embodiments are within the scope of the disclosure of the invention as disclosed and defined.

In embodiments shown the housing can comprise lighting elements such as LED's 77 in an edge portion of the housing 4, such that when a lid 12 is placed on the housing 4 light from the LED's 77 shines into the lid, especially into one or both walls 18A, 18B and/or in between them, for lighting the lid 12. Parts of or all of the lid may be transparent, such that the container is visible, especially branding provided thereon. The wall or walls 18 of the lid may be made to emit said light locally or over the full surface. Parts of the lid may be opaque or non transparent, for example to block or blur the view of the container from defined positions or angles.

FIG. 5 shows schematically how a system 1 of the disclosure could be used. First containers 3 can be pre-cooled, for example in a refrigerator 74. The lid 12 of the device 2 is removed from the housing 4, as is the handle 73. The lid 72 of the operating mechanism 30 is opened, such that a container 3 can be inserted into the housing, especially into the receptacle 5, the tapping line 35 being positioned in the channels, such that the valve 31 can be properly placed into the operating mechanism 30, in the holding element and grabbing element. It should be noticed that in advantageous embodiments, such as disclosed here, the channels in which the dispense line 35 has to be placed is entirely open, such that the dispense line can be positioned very easily, without have to be fed through openings or the like. Then the lid 72 of the operating mechanism is closed again and the lid 12 is placed over the container 3 onto the housing. The tapping handle 73 is replaced.

After proper installation of the container 3 the device 2 can be switched on or at least activated such that the ring 84 is rotated, forcing the slider or sliders 81 into the extended position, engaging properly with the inlets 52 and/or openings 9. Also the blade or blades 91 are forced against the adapter 38, under the ring 93, locking the container 3 further in position. The cooling, if not already operating, is activated for cooling the wall 11 to the proper temperature and the lighting, if provided, may be switched on.

During use gas under pressure will be supplied through the sliders 81 and the gas inlets 52, into the space 46, for pressurizing the inner container 3B. This pressurizes the beverage such that when opening the valve 31 beverage such as beer will flow out. A pressure sensor in for example the compressor, a gas line between compressor and slider or in a slider will sense the pressure and activate the compressor when the pressure needs to be increased. During use this allows for the pressure to be maintained within suitable limits, for example at about an equilibrium pressure of the beverage when carbonated.

In FIG. 7 an advantageous position of the bag 3B relative to the shoulder portion 8 of the outer container 3A is shown, showing close proximity. The distance may for example be, measured perpendicular to a tangent of the outer wall 3A, between 0 and 1 mm, preferably between 0 and 0.5 mm and more preferably between 0 and 0.2 mm. Preferably the shape of the shoulder portion between the body portion and the neck 7 is substantially spherical. It has been found that this provides for a proper fit, even if the temperature and/or pressure change and when the container is emptied during use.

The invention is by no means limited to the embodiments specifically disclosed and discussed here above. Many variations thereof are possible, including but not limited to combinations of parts of embodiments shown and described. For example the at least one opening 9 can be provided in a different position, for example extending through the closure ring 47, preferably in substantially radial direction outward, for example through the inner surface or wall of the ring, into the space between the containers, wherein the adapter 38 can extend into the ring for communicating properly with said at least one opening 9. The container can be provided with only one opening in the neck or several such openings. In embodiments the container can be a single wall container, wherein the gas can be inserted directly into the beverage, for example CO2 or nitrogen gas. In embodiments the container can be compressible by pressurizing the space within the lid. In embodiments the closure ring 47 and adapter 38 can be integrated. They can then be connected directly onto the container 3 as a closure and be suitable as the adapter. In embodiments the dispense adapter and the adapter can be integrated, with each other and/or with the closure ring. In stead of a valve in the container a different closure can be used, for example a pierceable closure, piercable by the adapter and/or the dispense adapter, or a removable closure which can then be replaced with the adapter and/or dispense adapter for cooperation with the tapping device.

These and many other amendments are considered to have been disclosed herein also, including but not limited to all combinations of elements of the invention as disclosed, within the scope of the invention as presented.

The invention claimed is:

1. Beverage dispensing assembly, comprising a dispenser and a beverage container, wherein the beverage container has a neck portion and a shoulder portion adjacent the neck portion, wherein the neck portion is provided with at least an outflow opening and at least one gas inlet opening and wherein the dispenser comprises a housing, wherein the housing is provided with a receptacle for receiving at least part of the container, wherein the container is positioned in the dispenser with the neck and shoulder portion facing downward, such that the neck portion and at least part of the shoulder portion are received in the receptacle, wherein part of the shoulder portion extends close to and/or is in contact with a wall of the receptacle, wherein a lid is provided over the container, enclosing a part of the container extending outside the receptacle.

2. Beverage dispensing assembly according to claim 1, wherein the container is provided with a dispensing unit, including at least a dispensing line, and the housing comprises a tap for connecting to and/or cooperating with the dispensing line.

3. Beverage dispensing assembly according to claim 2, wherein the dispensing line is a disposable line.

4. Beverage dispensing assembly according to claim 1, wherein the housing comprises a cooling device for cooling at least a part of the wall of the receptacle.

5. Beverage dispensing assembly according to claim 4, wherein the cooling device is for contact cooling of a part of at least the shoulder portion of the container.

6. Beverage dispensing assembly according to claim 1, wherein the receptacle is substantially bowl shaped, wherein the container is supported by at least a part of the wall of the receptacle.

7. Beverage dispensing assembly according to claim 1, wherein the receptacle is provided with an indentation at a lower end thereof for receiving the neck portion of the container.

8. Beverage dispensing assembly according to claim 1, wherein the lid is at least partly transparent, such that at least part of the container extending outside the receptacle can be seen through the lid.

9. Beverage dispensing assembly according to claim 1, wherein the lid rests on the housing, sealing a space between the lid and an outer surface of the container, wherein the lid isolates the container from a surrounding space.

10. Beverage dispensing assembly according to claim 1, wherein the lid is a double walled lid.

11. Beverage dispensing assembly according to claim 1, wherein the lid is made of plastic and/or glass.

12. Beverage dispensing assembly according to claim 1, wherein the container is a plastic BIC type container.

13. Beverage dispensing assembly according to claim 1, wherein the container is provided with a closure ring closing off the neck of the container, and wherein the closure ring and/or the neck portion of the container is or are provided with the at least one gas inlet opening, for introducing a fluid under pressure into the container, between an inner container and an outer container of the container.

14. Beverage dispensing assembly according to claim 13, wherein a beverage valve is provided in and/or on the dispense opening provided by the closure ring.

15. Beverage dispensing assembly according to claim 1, wherein an adapter is provided at the neck portion of the container.

16. Beverage dispensing assembly according to claim 15, wherein the adapter is an adapter fitting over at least part of the neck portion of the container, wherein the adapter comprises at least part of a dispensing unit, including at least a dispensing line, wherein the dispensing line at a first end is provided with a connector or dispense adapter for connecting to the outflow opening or a beverage dispensing valve provided in said outflow opening, and at an opposite end is provided with a beverage dispense opening.

17. Beverage dispensing assembly according to claim 16, wherein the beverage dispense opening is provided by a dispense valve integral to or connected to the dispense line.

18. Beverage dispensing assembly according to claim 15, wherein the adapter is arranged for connecting a gas connector of the dispenser with the at least one gas inlet opening.

19. Beverage dispensing assembly according to claim 15, wherein the container is a BIC type container, comprising an outer container and an inner container, wherein at least one gas inlet opening is provided in the neck portion of the container, in a peripheral wall portion of container, opening into a space between the inner and outer container, wherein the adapter covers at least said at least one gas inlet opening, and is provided with at least one adapter opening extending radially outward, in fluid communication with the said at least one gas inlet opening, and in fluid connection with a gas connector of the dispenser, wherein the housing is provided with a supply for gas under pressure, connected to the gas connector.

20. Beverage dispensing assembly according to claim 15, wherein the receptacle is provided with an indentation at a lower end thereof for receiving the neck portion of the container with the adapter.

21. Beverage dispensing assembly according to claim 20, wherein the adapter and the indentation are provided with orientation defining elements, such that the position of the adapter within said indentation is defined in a desired orientation relative to a gas connector of the dispenser.

22. Beverage dispensing assembly according to claim 1, wherein the dispenser is provided with at least one gas connector, movable relative to the container and/or the receptacle.

23. Beverage dispensing assembly according to claim 22, wherein the gas connector is movable mechanically.

24. Beverage dispensing assembly according to claim 23, wherein the sensing element and the at least one gas connector are coupled such that the gas connector can only be brought into an extended state if:

the sensing element detects a correct position of the container and/or an adapter thereof; or the sensing element detects a correct position of the container or an adapter thereof or senses no container or adapter thereof.

25. Beverage dispensing assembly according to claim 22, wherein the at least one gas connector is movable substantially radially relative to a longitudinal axis of the neck portion of the container.

26. Beverage dispensing assembly according to claim 1, wherein the dispenser is provided with at least one sensing element, movable relative to the container and/or receptacle, which sensing element engages the container and/or an adapter mounted on the neck portion of the container for sensing a correct position of the container and/or adapter in said receptacle, wherein the sensing element can be part of or form a locking element for locking the container inside the dispenser.

27. Beverage dispensing assembly according to claim 1, wherein the receptacle is provided with a channel extending from an indentation near a lower end thereof upward in a wall portion of the receptacle, wherein a dispensing line extends inside said channel.

28. Beverage dispensing assembly according to claim 1, wherein the container is a BIC type container, comprising an outer container and an inner container, wherein the inner container is substantially filled with a beverage and wherein the inner container at least has a shoulder portion which is flexible, such that the beverage pushes the shoulder portion of the inner container against an inner surface of the outer container within the receptacle.

29. Beverage dispensing assembly according to claim 1, wherein lighting is provided for illuminating at least part of the lid.

30. Beverage dispensing assembly according to claim 29, where in the lighting is provided in the housing, emitting light into the lid from a lower end thereof resting on said housing.

31. Beverage container for use in the beverage dispensing assembly according to claim 1, wherein the container is a BIC type container, wherein the container is provided with an adapter at a neck portion of the container, wherein the adapter:

connects to a gas inlet opening of the container and is provided with at least one adapter opening extending radially outward, in fluid communication with the said at least one gas inlet opening; and/or is provided with a dispensing unit including at least a dispensing line; and/or is provided with a non-circular outer portion for specific orientation of the adapter inside the housing.

32. Container according to claim 31, wherein the adapter is provided with an end surface with a slot or channel for receiving part of a or the dispensing line, such that the container can rest on the end surface without restricting flow of beverage through said dispense line.

33. Container according to claim 31, wherein the container is an integrally blow moulded from a preform assembly made of plastic.

34. Beverage dispensing assembly, comprising a dispenser and a beverage container, wherein the beverage container has a neck portion and a shoulder portion adjacent the neck portion, wherein the neck portion is provided with at least an outflow opening and at least one gas inlet opening and wherein the dispenser comprises a housing, wherein the housing is provided with a receptacle for receiving at least part of the container, wherein the container is positioned in the dispenser with the neck and shoulder portion facing downward, such that the neck portion and at least part of the shoulder portion are received in the receptacle, wherein part of the shoulder portion extends close to and/or is in contact with a wall of the receptacle, wherein the housing comprises a cooling device for cooling at least a part of the wall of the receptacle for contact cooling of a part of at least the shoulder portion of the container.

35. Beverage dispensing assembly according to claim 34, wherein a lid is provided over the container, enclosing a part of the container extending outside the receptacle.

36. Beverage dispensing assembly according to claim 35, wherein the lid is at least partly transparent.

* * * * *